US011003101B2

(12) United States Patent
Iwashita et al.

(10) Patent No.: US 11,003,101 B2
(45) Date of Patent: *May 11, 2021

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Yuko Iwashita, Osaka (JP); Kazunari Hamasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/740,028

(22) Filed: Jan. 10, 2020

(65) Prior Publication Data

US 2020/0233323 A1 Jul. 23, 2020

(30) Foreign Application Priority Data

Jan. 18, 2019 (JP) ..... JP2019-006906

(51) Int. Cl.
*G03G 5/00* (2006.01)
*G03G 5/06* (2006.01)
(Continued)

(52) U.S. Cl.
CPC ..... *G03G 5/0614* (2013.01); *G03G 5/047* (2013.01); *G03G 5/0564* (2013.01);
(Continued)

(58) Field of Classification Search
CPC .... G03G 5/047; G03G 5/0675; G03G 5/0614; G03G 5/0679
(Continued)

(56) References Cited

U.S. PATENT DOCUMENTS 7,514,191 B2 4/2009 Yanus et al.
7,985,521 B2 * 7/2011 Wu ..... G03G 5/0605 430/58.75

(Continued)

FOREIGN PATENT DOCUMENTS

JP 2007-293342 A 11/2007

*Primary Examiner* — Mark A Chapman
(74) *Attorney, Agent, or Firm* — Studebaker & Brackett PC

(57) ABSTRACT

An electrophotographic photosensitive member includes a conductive substrate and a photosensitive layer. The photosensitive layer is a single layer. The photosensitive layer contains a charge generating material, a hole transport material, an electron transport material, and a binder resin. The hole transport material includes a compound represented by chemical formula (1-1) or (1-2). The photosensitive layer further contains an n-type pigment. The n-type pigment is preferably an azo pigment or a perylene pigment.

(1-1)

(Continued)

-continued (1-2)

13 Claims, 2 Drawing Sheets

(51) Int. Cl.
*G03G 15/00* (2006.01)
*G03G 5/05* (2006.01)
*G03G 21/18* (2006.01)
*G03G 5/047* (2006.01)

(52) U.S. Cl.
CPC ..... *G03G 5/0618* (2013.01); *G03G 5/0657* (2013.01); *G03G 5/0675* (2013.01); *G03G 5/0679* (2013.01); *G03G 5/0696* (2013.01); *G03G 15/75* (2013.01); *G03G 21/1803* (2013.01)

(58) Field of Classification Search
USPC ..... 430/58.7
See application file for complete search history.

(56) References Cited

U.S. PATENT DOCUMENTS

2007/0254223 A1 11/2007 Yanus et al.
2007/0254226 A1 11/2007 Yanus et al.

* cited by examiner

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2019-006906, filed on Jan. 18, 2019. The contents of this application are incorporated herein by reference in their entirety.

BACKGROUND

The present disclosure relates to an electrophotographic photosensitive member, a process cartridge, and an image forming apparatus.

An electrophotographic photosensitive member is used as an image bearing member in an electrographic image forming apparatus (for example, a printer or a multifunction peripheral). An electrophotographic photosensitive member includes a photosensitive layer. As the electrophotographic photosensitive member, for example, a single-layer electrophotographic photosensitive member or a multi-layer electrophotographic photosensitive member is used. The single-layer electrophotographic photosensitive member includes a single-layer photosensitive layer having a charge generating function and a charge transport function. The multi-layer electrophotographic photosensitive member includes as the photosensitive layer a charge generating layer having a charge generating function and a charge transport layer having a charge transport function.

A known example of the electrophotographic photosensitive member is an image forming member including at least one charge transport layer containing a terphenyldiamine charge transport component having a specific structure. The terphenyldiamine charge transport component is represented by, for example, chemical formula (II).

(II)

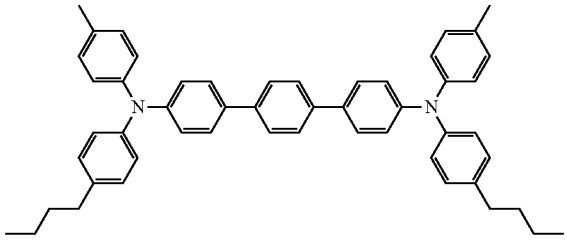

SUMMARY

An electrophotographic photosensitive member according to an aspect of the present disclosure includes a conductive substrate and a single-layer photosensitive layer. The photosensitive layer contains a charge generating material, a hole transport material, an electron transport material, and a binder resin. The hole transport material includes a compound represented by chemical formula (1-1) or (1-2). The photosensitive layer further contains an n-type pigment.

(1-1)

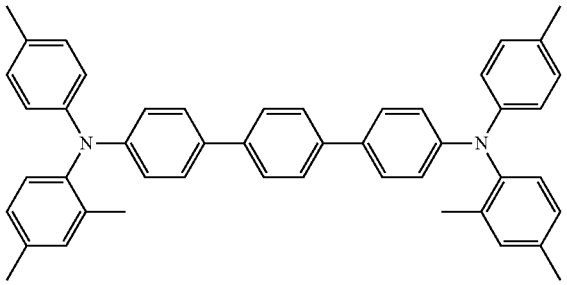

(1-2)

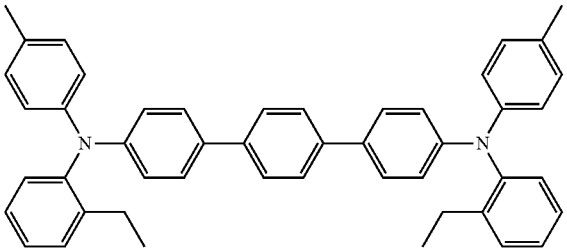

A process cartridge according to the present disclosure includes the electrophotographic photosensitive member described above.

An image forming apparatus according to the present disclosure includes an image bearing member, a charger, a light exposure device, a developing device, and a transfer device. The image bearing member is rotatable. The charger positively charges a surface of the image bearing member. The light exposure device forms an electrostatic latent image on the charged surface of the image bearing member by irradiating the surface of the image bearing member with exposure light. The developing device develops the electrostatic latent image into a toner image. The transfer device transfers the Loner image from the image bearing member to a transfer target. The image bearing member is the electrophotographic photosensitive member described above.

DETAILED DESCRIPTION

Figure 1:
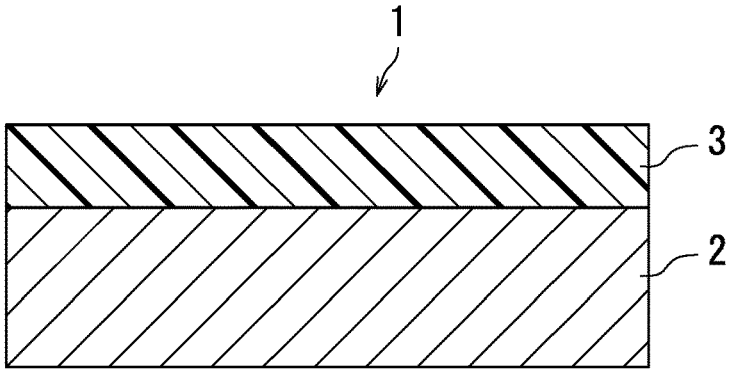
FIG. 1 is a partial cross sectional view of an electrophotographic photosensitive member according to an embodiment of the present disclosure.

The following describes an embodiment of the present disclosure in detail. However, the present disclosure is by no means limited to the following embodiment. The present disclosure can be practiced within a scope of objects of the present disclosure with alterations made as appropriate. Although some overlapping explanations may be omitted as appropriate, such omission does not limit the gist of the present disclosure. In the following description, the term "-based" may be appended to the name of a chemical compound to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

First, substituents used herein will be described. Examples of halogen atoms (halogen groups) include a fluorine atom (a fluoro group), a chlorine atom (a chloro group), a bromine atom (a bromo group), and an iodine atom (an iodine group).

An alkyl group having a carbon number of at least 1 and no greater than 10, an alkyl group having a carbon number of at least 1 and no greater than 6, an alkyl group having a carbon number of at least 1 and no greater than 5, an alkyl group having a carbon number of at least 1 and no greater than 4, and an alkyl group having a carbon number of at least 1 and no greater than 3 as used herein are each an unsubstituted straight chain or branched chain alkyl group unless otherwise specified. Examples of the alkyl group having a carbon number of at least 1 and no greater than 10 include a methyl group, an ethyl group, an n-propyl group, an isopropyl group, an n-butyl group, a sec-butyl group, a tert-butyl group, an n-pentyl group, a 1-methylbutyl group, a 2-methylbutyl group, a 3-methylbutyl group, a 1-ethylpropyl group, a 2-ethylpropyl group, a 1,1-dimethylpropyl group, a 1,2-dimethylpropyl group, a 2,2-dimethylpropyl group, an n-hexyl group, a 1-methylpentyl group, a 2-methylpentyl group, a 3-methylpentyl group, a 4-methylpentyl group, a 1,1-dimethylbutyl group, a 1,2-dimethylbutyl group, a 1,3-dimethylbutyl group, a 2,2-dimethylbutyl group, a 2,3-dimethylbutyl group, a 3,3-dimethylbutyl group, a 1,1,2-trimethylpropyl group, a 1,2,2-trimethylpropyl group, a 1-ethylbutyl group, a 2-ethylbutyl group, a 3-ethylbutyl group, a straight chain or branched chain heptyl group, a straight chain or branched chain octyl group, a straight chain or branched chain nonyl group, and a straight chain or branched chain decyl group. Examples of each of the alkyl group having a carbon number of at least 1 and no greater than 6, the alkyl group having a carbon number of at least 1 and no greater than 5, the alkyl group having a carbon number of at least 1 and no greater than 4, and the alkyl group having a carbon number of at least 1 and no greater than 3 are groups having a corresponding carbon number among the groups listed above as examples of the alkyl group having a carbon number of at least 1 and no greater than 10.

An alkoxy group having a carbon number of at least 1 and no greater than 6 and an alkoxy group having a carbon number of at least 1 and no greater than 3 as used herein are each an unsubstituted straight chain or branched chain alkoxy group unless otherwise specified. Examples of the alkoxy group having a carbon number of at least 1 and no greater than 6 include a methoxy group, an ethoxy group, an n-propoxy group, an isopropoxy group, an n-butoxy group, a sec-butoxy group, a tert-butoxy group, an n-pentoxy group, a 1-methylbutoxy group, a 2-methylbutoxy group, a 3-methylbutoxy group, a 1-ethylpropoxy group, a 2-ethylpropoxy group, a 1,1-dimethylpropoxy group, a 1,2-dimethylpropoxy group, a 2,2-dimethylpropoxy group, an n-hexyloxy group, a 1-methylpentyloxy group, a 2-methylpentyloxy group, a 3-methylpentyloxy group, a 4-methylpentyloxy group, a 1,1-dimethylbutoxy group, a 1,2-dimethylbutoxy group, a 1,3-dimethylbutoxy group, a 2,2-dimethylbutoxy group, a 2,3-dimethylbutoxy group, a 3,3-dimethylbutoxy group, a 1,1,2-trimethylpropoxy group, a 1,2,2-trimethylpropoxy group, a 1-ethylbutoxy group, a 2-ethylbutoxy group, and a 3-ethylbutoxy group. Examples of the alkoxy groups having a carbon number of at least 1 and no greater than 3 are groups having a carbon number of at least 1 and no greater than 3 among the groups listed above as examples of the alkoxy group having a carbon number of at least 1 and no greater than 6.

An aryl group having a carbon number of at least 6 and no greater than 14 and an aryl group having a carbon number of at least 6 and no greater than 10 as used herein are each an unsubstituted aryl group unless otherwise specified. Examples of the aryl group having a carbon number of at least 6 and no greater than 14 include a phenyl group, a naphthyl group, an indacenyl group, a biphenylenyl group, an acenaphthylenyl group, an anthryl group, a phenanthryl group, and a fluorenyl group. Examples of the aryl group having a carbon number of at least 6 and no greater than 10 include a phenyl group and a naphthyl group.

An aryloxy group having a carbon number of at least 6 and no greater than 14 as used herein is an unsubstituted aryloxy group unless otherwise specified. Examples of the aryloxy group having a carbon number of at least 6 and no greater than 14 include a phenoxy group, a naphthoxy group, an indacenyloxy group, a biphenylenyloxy group, an acenaphthylenyloxy group, an anthryloxy group, a phenanthryloxy group, and a fluorenyloxy group.

An alkenyl group having a carbon number of at least 2 and no greater than 6 as used herein is an unsubstituted straight chain or branched chain alkenyl group unless otherwise specified. The alkenyl group having a carbon number of at least 2 and no greater than 6 has at least 1 and no greater than 3 double bonds. Examples of the alkenyl group having a carbon number of at least 2 and no greater than 6 include an ethenyl group, a propenyl group, a butenyl group, a butadienyl group, a pentenyl group, a hexenyl group, a hexadienyl group, and a hexatrinyl group.

A heterocyclic group having a carbon number of at least 3 and no greater than 14 as used herein is an unsubstituted heterocyclic group unless otherwise specified. A heterocyclic group has a hetero atom. Examples of the hetero atom include a nitrogen atom, an oxygen atom, and a sulfur atom. Examples of the heterocyclic group having a carbon number of at least 3 and no greater than 14 include a piperidinyl group, a piperazinyl group, a morpholinyl group, a thiophenyl group, a furanyl group, a pyrrolyl group, an imidazolyl group, a pyrazolyl group, an isothiazolyl group, an isoxazolyl group, an oxazolyl group, an isoxazolyl group, a thiazolyl group, an isothiazolyl group, a furazanyl group, a pyranyl group, a pyridyl group, a pyridazinyl group, a pyrimidinyl group, a pyrazinyl group, an indolyl group, a 1H-indazolyl group, an isoindolyl group, a chromenyl group, a quinolinyl group, an isoquinolinyl group, a purinyl group, a pteridinyl group, a triazolyl group, a tetrazolyl group, a 4H-quinolidinyl group, a naphthyridinyl group, a benzofuranyl group, a 1,3-benzodioxolyl group, a benzoxazolyl group, a benzothiazolyl group, a benzimidazolyl group, a carbazolyl group, a phenanthridinyl group, an acridinyl group, a phenazinyl group, and a phenanthrolinyl group.

An aralkyl group having a carbon number of at least 7 and no greater than 20, an aralkyl group having a carbon number of at least 7 and no greater than 12, and an aralkyl group having a carbon number of at least 7 and no greater than 10 as used herein are each an unsubstituted aralkyl group unless otherwise specified. The aralkyl group having a carbon number of at least 7 and no greater than 20 is, for example, an alkyl group having a carbon number of at least 1 and no greater than 6 and being substituted with an aryl group having a carbon number of at least 6 and no greater than 14. The aralkyl group having a carbon number of at least 7 and no greater than 20 is, for example, an alkyl group having a carbon number of at least 1 and no greater than 2 and being substituted with a naphthyl group or an alkyl group having a carbon number of at least 1 and no greater than 6 and being substituted with a phenyl group. The aralkyl group having a carbon number of at least 7 and no greater than 10 is, for example, an alkyl group having a carbon number of at least 1 and no greater than 4 and being substituted with a phenyl group.

An aralkyloxy group having a carbon number of at least 7 and no greater than 20 and an aralkyloxy group having a carbon number of at least 7 and no greater than 10 as used herein are each an unsubstituted aralkyloxy group unless otherwise specified. The aralkyloxy group having a carbon number of at least 7 and no greater than 20 is, for example, an alkoxy group having a carbon number of at least 1 and no greater than 6 and being substituted with an aryl group having a carbon number of at least 6 and no greater than 14. The aralkyloxy group having a carbon number of at least 7 and no greater than 10 is, for example, an alkoxy group having a carbon number of at least 1 and no greater than 4 and being substituted with a phenyl group.

<Electrophotographic Photosensitive Member>

Figure 2:
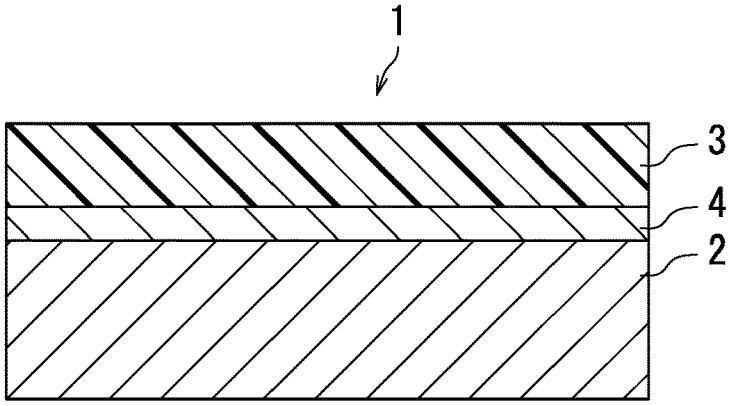
FIG. 2 is a partial cross sectional view of the electrophotographic photosensitive member according to the embodiment of the present disclosure.
Figure 3:
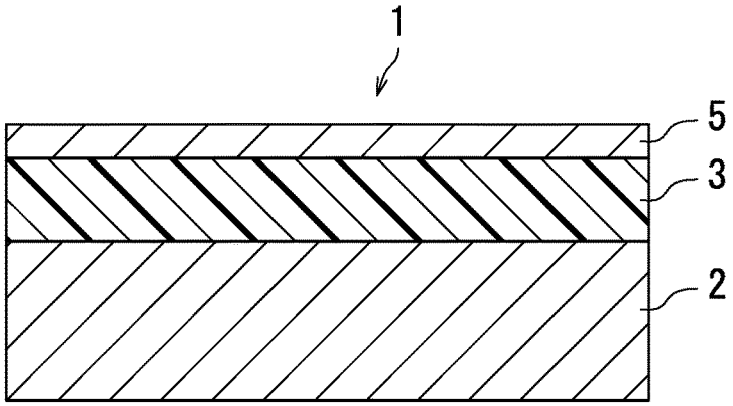
FIG. 3 is a partial cross sectional view of the electrophotographic photosensitive member according to the embodiment of the present disclosure.

The present embodiment relates to an electrophotographic photosensitive member (also referred to below as a photosensitive member). The following describes a photosensitive member 1 with reference to FIGS. 1 to 3. FIGS. 1 to 3 each are a partial cross sectional view of the photosensitive member 1.

As illustrated in FIG. 1, the photosensitive member 1 includes, for example, a conductive substrate 2 and a photosensitive layer 3. The photosensitive layer 3 is a single layer. The photosensitive member 1 is a single-layer electrophotographic photosensitive member including a photosensitive layer 3 of a single layer.

As illustrated in FIG. 2, the photosensitive member 1 may include the conductive substrate 2, the photosensitive layer 3, and an intermediate layer 4 (undercoat layer). The intermediate layer 4 is disposed between the conductive substrate 2 and the photosensitive layer 3. The photosensitive layer 3 may be located directly on the conductive substrate 2 as illustrated in FIG. 1. Alternatively, the photosensitive layer 3 may be located on the conductive substrate 2 with the intermediate layer 4 therebetween as illustrated in FIG. 2.

The photosensitive member 1 may include the conductive substrate 2, the photosensitive layer 3, and a protective layer 5 as illustrated in FIG. 3. The protective layer 5 is disposed on the photosensitive layer 3. The photosensitive layer 3 may be disposed as an outermost surface layer of the photosensitive member 1 as illustrated in FIGS. 1 and 2. Alternatively, the protective layer 5 may be disposed as an outermost surface layer of the photosensitive member 1 as illustrated in FIG. 3.

The photosensitive layer 3 contains a charge generating material, a hole transport material, an electron transport material, a binder resin, and an n-type pigment.

The thickness of the photosensitive layer 3 is not particularly limited, but is preferably at least 5 μm and no greater than 100 μm, and more preferably at least 10 μm and no greater than 50 μm. The photosensitive member 1 has been described so far with reference to FIGS. 1 to 3.

(Charge Generating Material)

Examples of the charge generating material include phthalocyanine pigments, perylene pigments, bisazo pigments, trisazo pigments, dithioketopyrrolopyrrole pigments, metal-free naphthalocyanine pigments, metal naphthalocyanine pigments, squaraine pigments, indigo pigments, azurenium pigments, cyanine pigments, powders of inorganic photoconductive materials (for example, selenium, selenium-tellurium, selenium-arsenic, cadmium sulfide, and amorphous silicon), pyrylium pigments, ansanthrone pigments, triphenylmethane pigments, threne pigments, toluidine pigments, pyrazoline pigments, and quinacridone pigments. The photosensitive layer may contain only one charge generating material or two or more charge generating materials.

Phthalocyanine pigments are pigments each having a phthalocyanine structure. Examples of the phthalocyanine pigments include metal-free phthalocyanine and metal phthalocyanine. Examples of the metal phthalocyanine include titanyl phthalocyanine, hydroxygallium phthalocyanine, and chlorogallium phthalocyanine. Metal-free phthalocyanine is represented by chemical formula (CGM-1). Titanyl phthalocyanine is represented by chemical formula (CGM-2).

(CGM-1)

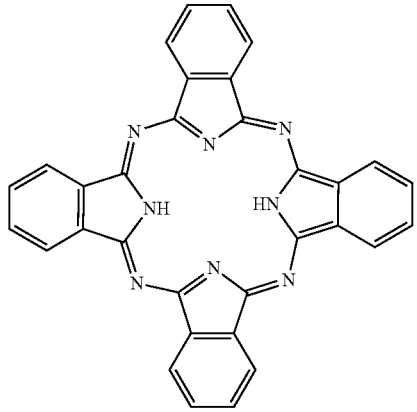

(CGM-2)

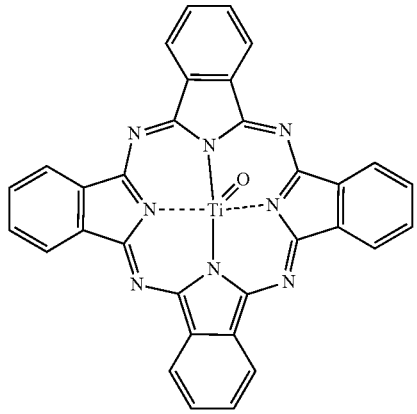

The phthalocyanine pigments may be crystalline or non-crystalline. An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanine having an α-form crystal structure, titanyl phthalocyanine having a β-form crystal structure, and titanyl phthalocyanine having a Y-form crystal structure (also referred to below as α-form titanyl phthalocyanine, β-form titanyl phthalocyanine, and Y-form titanyl phthalocyanine, respectively).

For example, in a digital optical image forming apparatus (for example, a laser beam printer or facsimile machine that uses a light source such as a semiconductor laser), a photosensitive member that is sensitive to a region of wavelengths of 700 nm or longer is preferably used. In terms of having high quantum yield in a wavelength range of 700 nm or longer, the charge generating material is preferably a phthalocyanine pigment, more preferably metal-free phthalocyanine or titanyl phthalocyanine, further preferably titanyl phthalocyanine, and particularly preferably Y-form titanyl phthalocyanine. As a result of the photosensitive layer containing a phthalocyanine pigment such as above in combination with the hole transport material (1-1) or (1-2) and the n-type pigment, it is possible to further improve charging stability of the photosensitive member and further inhibit crystallization of the photosensitive layer.

Y-form titanyl phthalocyanine exhibits a main peak at a Bragg angle (2θ±0.2°) of for example 27.2° in a CuKα characteristic X-ray diffraction spectrum. The term main peak refers to a peak that exhibits a most intense or second most intense peak within a range of Bragg angles (2θ±0.2°) from 3° to 40° in a CuKα characteristic X-ray diffraction spectrum. Y-form titanyl phthalocyanine does not exhibit a peak at 26.2° in a CuKα characteristic X-ray diffraction spectrum.

The CuKα characteristic X-ray diffraction spectrum can be measured by, for example, a method described below. First, a sample (titanyl phthalocyanine) is loaded into a sample holder of an X-ray diffraction spectrometer (for example, "RINT (registered Japanese trademark) 1100", product of Rigaku Corporation) and an X-ray diffraction spectrum is measured using a Cu X-ray tube, a tube voltage of 40 kV, a tube current of 30 mA, and CuKα characteristic X-rays having a wavelength of 1.542 Å. The measurement range (2θ) is, for example, from 3° to 40° (start angle: 3°, stop angle: 40°), and the scanning speed is, for example, 10°/minute. A main peak in the obtained X-ray diffraction spectrum is determined, and the Bragg angle of the main peak is read therefrom.

The amount of the charge generating material is preferably at least 0.1 parts by mass and no greater than 50 parts by mass relative to 100 parts by mass of the binder resin contained in the photosensitive layer, and more preferably at least 0.5 parts by mass and no greater than 4.5 parts by mass.

(Hole Transport Material)

The hole transport material includes a compound represented by chemical formula (1-1) or (1-2). The compounds represented by chemical formulas (1-1) and (1-2) may also be referred to below as compounds (1-1) and (1-2), respectively. The photosensitive layer contains the compound (1-1) or (1-2) as the hole transport material.

(1-1)

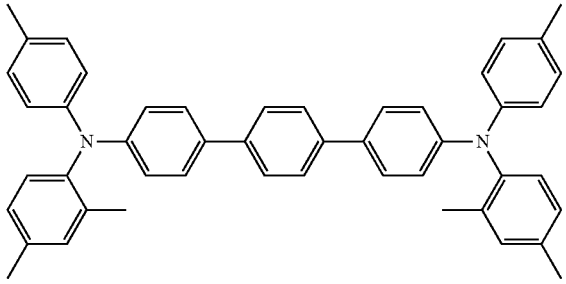

-continued (1-2)

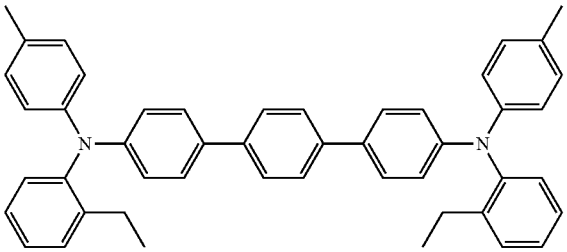

As a result of the photosensitive layer containing the compound (1-1) or (1-2) as the hole transport material, it is possible to improve charging stability of the photosensitive member and inhibit crystallization of the photosensitive layer. Presumably, the reason therefor is as follows. Note that the charging stability is a characteristic that allows the photosensitive member to be charged to a charge potential within a predetermined range even after image formation on a recording medium is repeated.

The first reason is as follows. Each of the four phenyl groups in chemical formula (1-1) has a predetermined substituent at a predetermined position (predetermined substitution position). Similarly, each of the four phenyl groups in chemical formula (1-2) has a predetermined substituent at a predetermined position. Each predetermined substituent is not a bulky substituent. An unbulky predetermined substituent located at a predetermined position tends to fill minute gaps in the photosensitive layer. For this reason, even in a situation where image formation on a recording medium is repeated, it is possible to prevent an extraneous component (for example, a gas) that may cause degradation of the photosensitive member from entering the photosensitive layer. As a result, charging stability of the photosensitive member is improved.

The second reason is as follows. When each substituent in each phenyl group in chemical formulas (1-1) and (1-2) is not the predetermined substituent (for example, is a methoxy group) or the substituent is not located at a predetermined position, the hole transport material has an impaired hole transport ability, thereby impairing charging stability. As a result of each of the four phenyl groups in chemical formula (1-1) and (1-2) having a predetermined substituent at a predetermined position, the hole transport ability of the compounds (1-1) and (1-2) is improved, and thereby the charging stability of the photosensitive member is improved.

The third reason is as follows. In general, a compound having a terphenyl structure tends to cause crystallization of the photosensitive layer. As a result of intensive investigation, the present inventors found that it is possible to inhibit crystallization of the photosensitive layer when the phenyl groups in chemical formula (1-1) and (1-2) each have a predetermined substituent at a predetermined position. When each phenyl group has a predetermined substituent at a predetermined position, an appropriate distance for preventing an excessively strong intermolecular force is provided between the compound (1-1) or (1-2) and other molecules contained in the photosensitive layer. As a result, crystallization of the photosensitive layer can be inhibited.

The fourth reason is as follows. As described above, the predetermined substituent in each phenyl group in chemical formula (1-1) and (1-2) is not a bulky substituent. A compound having a bulky substituent tends to cause crystallization of the photosensitive layer. When the phenyl groups in chemical formulas (1-1) and (1-2) each have a predetermined substituent at a predetermined position, it is possible to inhibit crystallization of the photosensitive layer. The reasons for improvement in charging stability of the photosensitive member and for inhibition of crystallization of the photosensitive layer have been described so far.

The amount of the hole transport material is preferably at least 10 parts by mass relative to 100 parts by mass of the binder resin, more preferably at least 50 parts by mass, and still more preferably at least 65 parts by mass. The amount of the hole transport material is preferably no greater than 300 parts by mass relative to 100 parts by mass of the binder resin, more preferably no greater than 100 parts by mass, and still more preferably no greater than 75 parts by mass.

The photosensitive layer may contain only the compound (1-1) or (1-2) as the hole transport material. The photosensitive layer may further contain a hole transport material that is neither the compound (1-1) nor the compound (1-2) (also referred to below as an additional hole transport material) in addition to the compound (1-1) or (1-2).

Examples of the additional hole transporting material include oxadiazole compounds (for example, 2,5-di(4-methylaminophenyl)-1,3,4-oxadiazole), styryl compounds (for example, 9-(4-diethylaminostyryl)anthracene), carbazole compounds (for example, polyvinyl carbazole), organic polysilane compounds, pyrazoline-based compounds (for example, 1-phenyl-3-(p-dimethylaminophenyl)pyrazoline), hydrazone compounds, indole-based compounds, oxazole-based compounds, isoxazole-based compounds, thiazole-based compounds, thiadiazole-based compounds, imidazole-based compounds, pyrazole-based compounds, and triazole-based compounds.

Each of the compounds (1-1) and (1-2) can be produced, for example, through a reaction represented by the following reaction formula (r1) (also referred to below as a reaction (r1)). Y in general formula (a) in reaction formula (r1) represents a halogen atom. In production of the compound (1-1), $R^1$ and $R^2$ in general formulas (b) and (1) each represent a methyl group, and $R^3$ and $R^4$ in general formulas (c) and (1) each represent a methyl group. In production of the compound (1-2), $R^1$ and $R^2$ in general formulas (b) and (1) represent a hydrogen atom and an ethyl group, respectively, and $R^3$ and $R^4$ in general formulas (c) and (1) represent a hydrogen atom and an ethyl group, respectively. The compounds represented by general formulas (a), (b), (c), and (1) may be referred to below as compounds (a), (b), (c), and (1), respectively.

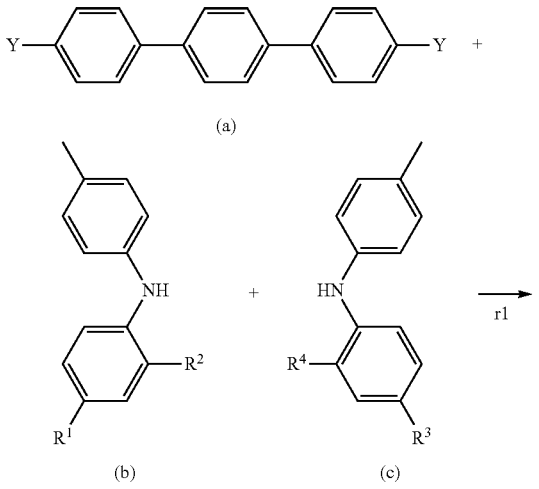

-continued

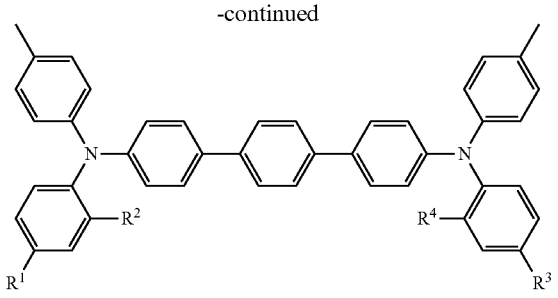

(1)

In reaction (r1), 1 molar equivalent of the compound (a), 1 molar equivalent of the compound (b), and 1 molar equivalent of the compound (c) are reacted to give 1 molar equivalent of the compound (1) (specifically, the compound (1-1) or (1-2)). When $R^1$ and $R^3$ are the same as each other and $R^2$ and $R^4$ are the same as each other in general formula (1), 2 molar equivalents of the compound (b) are used instead of 1 molar equivalent of the compound (b) and 1 molar equivalent of the compound (c).

The reaction (r1) may be carried out in the presence of a palladium catalyst. Examples of the palladium catalyst include palladium(II) acetate, palladium(II) chloride, hexachloropalladium(IV) sodium tetrahydrate, and tris(dibenzylideneacetone)dipalladium(0).

The reaction (r1) may be carried out in the presence of a ligand. Examples of the ligand include (4-dimethylaminophenyl)di-tertbutylphosphine, tricyclohexylphosphine, triphenylphosphine, and methyldiphenylphosphine.

The reaction (r1) may be carried out in the presence of a base. Examples of the base include sodium tert-butoxide, tripotassium phosphate, and cesium fluoride. The amount of the base is preferably at least 1 molar equivalent and no greater than 10 molar equivalents relative to 1 molar equivalent of the compound (b).

The reaction (r1) may be carried out in a solvent. Examples of the solvent include xylene, toluene, tetrahydrofuran, and dimethylformamide.

The reaction (r1) is preferably carried out at a reaction temperature of 80° C. or higher and 140° C. or lower. The reaction (r1) is preferably carried out for a reaction time of 1 hour or longer and 10 hours or shorter. The reaction (r1) may be carried out in an inert gas atmosphere (for example, an argon gas atmosphere).

(Binder Resin)

Examples of the binder resin include thermoplastic resins (more specifically, polycarbonate resins, polyarylate resins, styrene-based resins, styrene-butadiene copolymers, styrene-acrylonitrile copolymers, styrene-maleic acid copolymers, styrene-acrylic acid copolymers, acrylic copolymers, polyethylene resins, ethylene-vinyl acetate copolymers, chlorinated polyethylene resins, polyvinyl chloride resins, polypropylene resins, ionomers, vinyl chloride-vinyl acetate copolymers, polyester resins, alkyd resins, polyamide resins, polyurethane resins, polysulfone resins, diallyl phthalate resins, ketone resins, polyvinyl butyral resins, and polyether resins), thermosetting resins (more specifically, silicone resins, epoxy resins, phenolic resins, urea resins, melamine resins, and other cross-linkable thermosetting resins), and photocurable resins (more specifically, epoxy-acrylic acid-based resins and urethane-acrylic acid-based copolymers).

In order to improve charging stability of the photosensitive member and inhibit crystallization of the photosensitive layer, the binder resin is preferably a polycarbonate resin, and more preferably a polycarbonate resin having a repeating unit represented by chemical formula (R1), (R2), (R3), or (R4). The "polycarbonate resins having a repeating unit represented by chemical formulas (R1), (R2), (R3), and (R4)" may be referred to below as "polycarbonate resins (R1), (R2), (R3), and (R4)", respectively.

(R1)

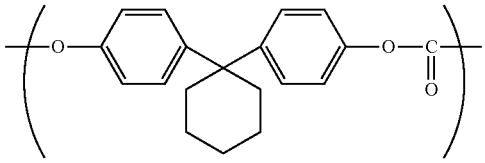

(R2)

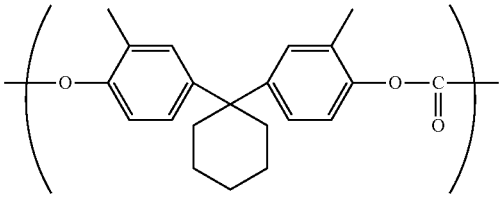

(R3)

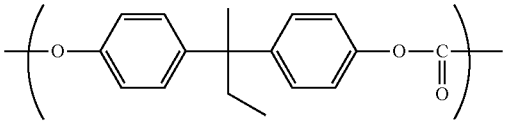

(R4)

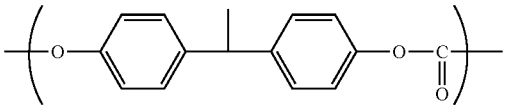

The binder resin preferably has a viscosity average molecular weight of at least 20,000, more preferably at least 30,000, and still more preferably at least 40,000. The binder resin preferably has a viscosity average molecular weight of no greater than 80,000, more preferably no greater than 70,000, and still preferably no greater than 60,000. When the viscosity average molecular weight of the binder resin is at least 20,000, the photosensitive layer 3 is hardly abraded. On the other hand, when the viscosity average molecular weight of the binder resin is no greater than 80,000, the binder resin tends to easily dissolve in a solvent, facilitating formation of the photosensitive layer.

(Electron Transport Material)

Examples of the electron transport material include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds include diphenoquinone-based compounds, azoquinone-based compounds, anthraquinone-based compounds, naphthoquinone-based compounds, nitroanthraquinone-based compounds, and dinitroanthraquinone-based compounds. The photosensitive layer may contain only one electron transport material or two or more electron transport materials.

Preferable examples of the electron transport material in order to improve charging stability of the photosensitive member and inhibit crystallization of the photosensitive layer include compounds represented by general formulas (10), (11), (12), (13), and (14) (also referred to below as compounds (10), (11), (12), (13), and (14), respectively).

(10)

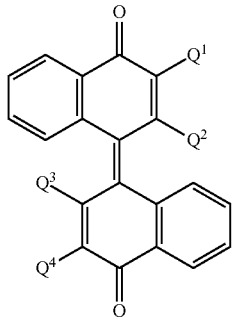

(11)

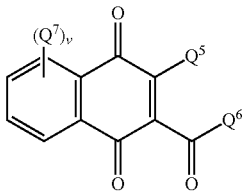

(12)

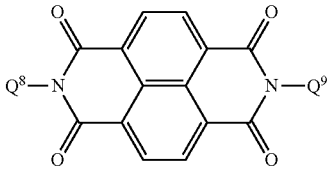

(13)

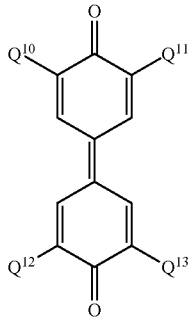

(14)

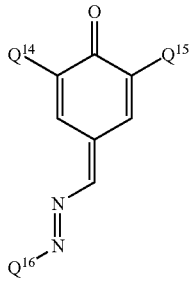

In general formula (10), $Q^1$, $Q^2$, $Q^3$, and $Q^4$ each represent, independently of one another, a hydrogen atom, an alkyl group having a carbon number of at least 1 and no greater than 6, an alkoxy group having a carbon number of at least 1 and no greater than 6, an aryl group having a carbon number of at least 6 and no greater than 14, or an aralkyl group having a carbon number of at least 7 and no greater than 20.

Preferably, in general formula (10), $Q^1$, $Q^2$, $Q^3$, and $Q^4$ each represent, independently of one another, a hydrogen atom or an alkyl group having a carbon number of at least 1 and no greater than 6. More preferably, $Q^1$ and $Q^4$ each represent, independently of each other, an alkyl group having a carbon number of at least 1 and no greater than 6 and $Q^2$ and $Q^3$ each represent a hydrogen atom. The alkyl group having a carbon number of at least 1 and no greater than 6 represented by $Q^1$, $Q^2$, $Q^3$, and $Q^4$ is preferably an alkyl group having a carbon number of at least 1 and no greater than 5, and more preferably a 1,1-dimethylpropyl group.

In general formula (11), Q represents an alkyl group having a carbon number of at least 1 and no greater than 6 or an aryl group having a carbon number of at least 6 and no greater than 14. $Q^6$ represents an alkyl group having a carbon number of at least 1 and no greater than 6, an aryl group having a carbon number of at least 6 and no greater than 14, an alkoxy group having a carbon number of at least 1 and no greater than 6, an aralkyl group having a carbon number of at least 7 and no greater than 20, an aryloxy group having a carbon number of at least 6 and no greater than 14, or an aralkyloxy group having a carbon number of at least 7 and no greater than 20. $Q^7$ represents an alkyl group having a carbon number of at least 1 and no greater than 6. In general formula (11), v represents an integer of at least 0 and no greater than 4.

In general formula (11), $Q^5$ preferably represents an aryl group having a carbon number of at least 6 and no greater than 14, and more preferably represents a phenyl group. $Q^6$ preferably represents an aralkyloxy group having a carbon number of at least 7 and no greater than 20, more preferably represents an aralkyloxy group having a carbon number of at least 7 and no greater than 10, and still more preferably represents a benzyloxy group. Preferably, v represents 0.

In general formula (12), $Q^8$ and $Q^9$ each represent, independently of each other, an aryl group having a carbon number of at least 6 and no greater than 14 and optionally being substituted with at least one alkyl group having a carbon number of at least 1 and no greater than 6.

In general formula (12), $Q^8$ and $Q^9$ preferably each represent, independently of each other, an aryl group having a carbon number of at least 6 and no greater than 14 and being substituted with 2 to 5 (for example, 2) alkyl groups each having a carbon number of at least 1 and no greater than 6, more preferably a phenyl group and being substituted with 2 to 5 (for example, 2) alkyl groups each having a carbon number of at least 1 and no greater than 3, still more preferably an ethylmethylphenyl group, and particularly preferably a 2-ethyl-6-methylphenyl group.

In general formula (13), $Q^{10}$, $Q^{11}$, $Q^{12}$, and $Q^{13}$ each represent, independently of one another, a hydrogen atom, an alkyl group having a carbon number of at least 1 and no greater than 6, an alkenyl group having a carbon number of at least 2 and no greater than 6, an alkoxy group having a carbon number of at least 1 and no greater than 6, an aryl group having a carbon number of at least 6 and no greater than 14, an aralkyl group having a carbon number of at least 7 and no greater than 20, or a heterocyclic group having a carbon number of at least 3 and no greater than 14.

In general formula (13), $Q^{10}$, $Q^{11}$, $Q^{12}$, and $Q^{13}$ preferably each represent, independently of one another, an alkyl group having a carbon number of at least 1 and no greater than 6, more preferably an alkyl group having a carbon number of at least 1 and no greater than 4, and still more preferably a methyl group or a tert-butyl group.

In the general formula (14), $Q^{14}$, $Q^{15}$, and $Q^{16}$ each represent, independently of one another, an alkyl group having a carbon number of at least 1 and no greater than 6, or an aryl group having a carbon number of at least 6 and no greater than 14 and optionally being substituted with a halogen atom.

In general formula (14), $Q^{14}$ and $Q^{15}$ preferably each represent, independently of each other, an alkyl group having a carbon number of at least 1 and no greater than 6, more preferably an alkyl group having a carbon number of at least 1 and no greater than 4, and still more preferably a tert-butyl group. $Q^{16}$ represents preferably an aryl group having a carbon number of at least 6 and no greater than 14 and being substituted with a halogen atom, more preferably a phenyl group substituted with a halogen atom, still more preferably a chlorophenyl group, and particularly preferably a 4-chlorophenyl group.

Preferable examples of the electron transport material in order to improve charging stability of the photosensitive member and inhibit crystallization of the photosensitive layer include compounds represented by chemical formulas (ET1), (ET2), (ET3), (ET4), and (ET5) (also referred to below as compounds (ET1), (ET2), (ET3), (ET4), and (ET5), respectively). The compound (ET1) is a preferable example of the compound (10). The compound (ET2) is a preferable example of the compound (11). The compound (ET3) is a preferable example of the compound (12). The compound (ET4) is a preferable example of the compound (13). The compound (ET5) is a preferable example of the compound (14).

(ET1)

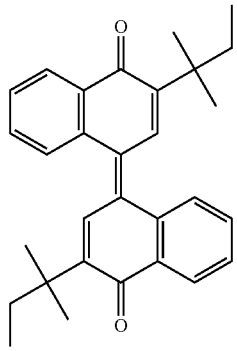

(ET2)

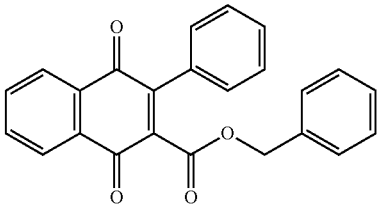

(ET3)

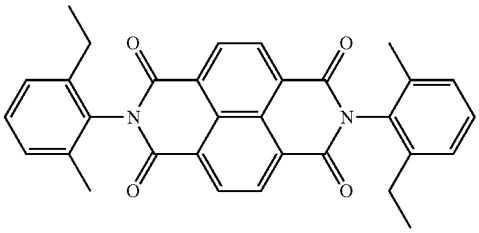

-continued (ET4)

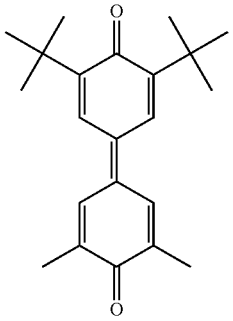

(ET5)

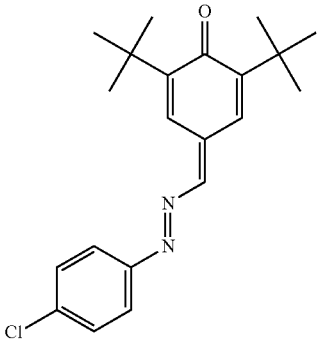

The amount of the electron transport material is preferably at least 5 parts by mass and no greater than 150 parts by mass relative to 100 parts by mass of the binder resin, more preferably at least 10 parts by mass and no greater than 50 parts by mass, and still more preferably at least 20 parts by mass and no greater than 40 parts by mass.

(n-Type Pigment)

Pigments are roughly classified into n-type pigments and p-type pigments. An n-type pigment is a pigment where majority charge carriers are electrons. A p-type pigment is a pigment where majority charge carriers are holes. In the photosensitive member according to the present embodiment, the photosensitive layer contains an n-type pigment. As a result of the photosensitive layer containing an n-type pigment, charging stability of the photosensitive member can be improved. As a result of the photosensitive layer containing an n-type pigment and the compound (1-1) or (1-2) which is a hole transport material, charging stability of the photosensitive member is remarkably improved. As a result of the photosensitive layer containing an n-type pigment, sensitivity characteristics of the photosensitive member are also improved. Examples of the n-type pigment include azo pigments and perylene pigments.

The following describes an azo pigment as an example of the n-type pigment. An azo pigment has an azo group (—N=N—). Examples of the azo pigment include monoazo pigments and polyazo pigments (for example, bisazo pigments, trisazo pigments, and tetrakisazo pigments). The azo pigment may be a tautomer. The azo pigment may have a chlorine atom (chloro group) in addition to the azo group.

The azo pigment may be, for example, a known azo pigment. Preferable examples of the azo pigment include Pigment Yellow (14, 17, 49, 65, 73, 83, 93, 94, 95, 128, 166, or 77), Pigment Orange (1, 2, 13, 34, or 36), and Pigment Red (30, 32, 61, or 144).

More preferable examples of the azo pigment include an azo pigment represented by chemical formula (A1) (Pigment Yellow 128), an azo pigment represented by chemical formula (A2) (Pigment Yellow 93), an azo pigment represented by chemical formula (A3) (Pigment Orange 13), and an azo pigment represented by chemical formula (A4) (Pigment Yellow 83). The azo pigments represented by chemical formulas (A1), (A2), (A3), and (A4) are also referred to below as azo pigments (A1), (A2), (A3), and (A4), respectively.

(A1)

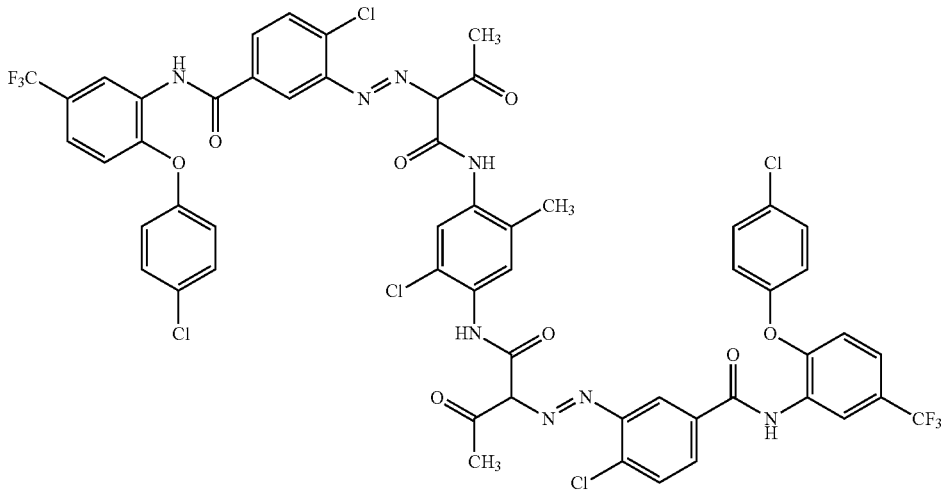

-continued (A2)

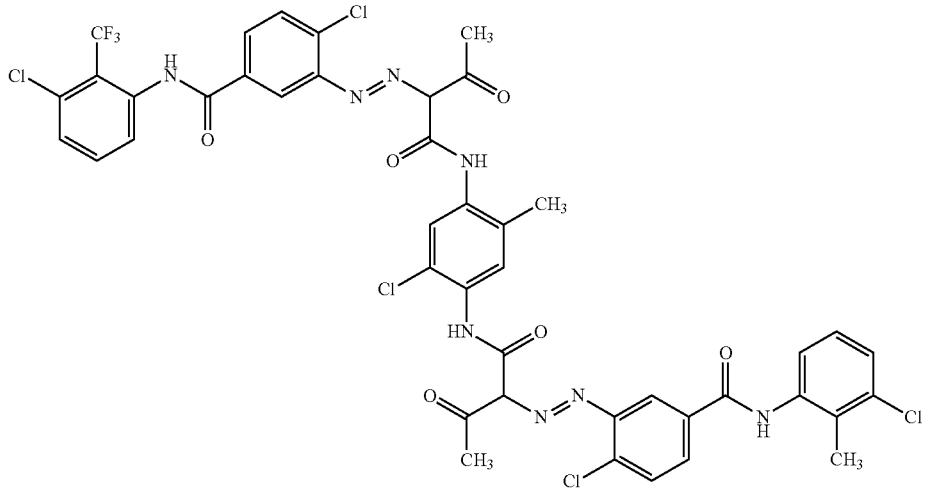

(A3)

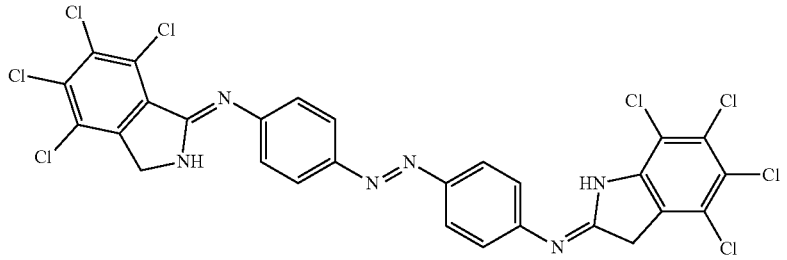

(A4)

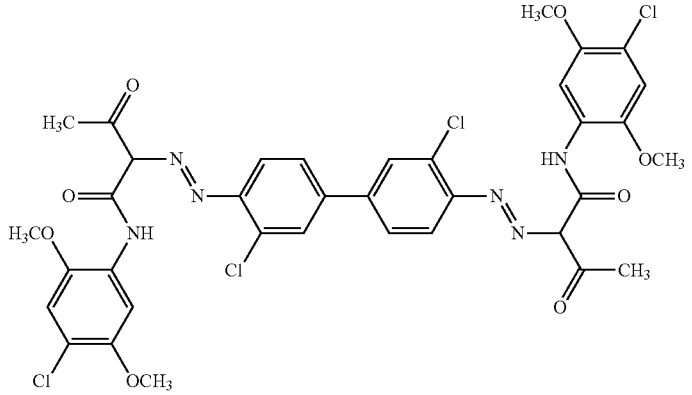

The following describes a perylene pigment as an example of the n-type pigment. A perylene pigment has a perylene skeleton represented by general formula (P-I). In general formula (P-I), $R^{40}$ and $R^{41}$ each represent, independently of each other, a divalent organic group.

(P-I)

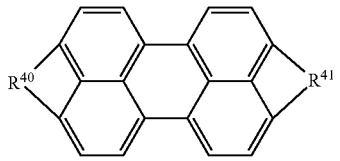

A first specific example of the perylene pigment is a perylene pigment represented by general formula (P-II).

(P-II)

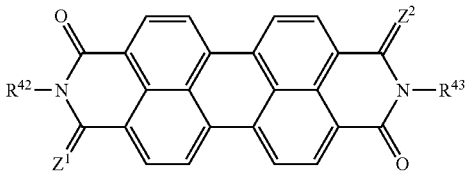

In general formula (P-II), $R^{42}$ and $R^{43}$ each represent, independently of each other, a hydrogen atom or a monovalent organic group. $Z^1$ and $Z^2$ each represent, independently of each other, an oxygen atom or a nitrogen atom.

Examples of the monovalent organic group represented by $R^{42}$ or $R^{43}$ in general formula (P-II) include an aliphatic hydrocarbon group, an alkoxy group, an optionally substituted aralkyl group, an optionally substituted aryl group, and an optionally substituted heterocyclic group.

The aliphatic hydrocarbon group represented by $R^{42}$ or $R^{43}$ in general formula (P-II) may be any of a straight chain, branched chain, or cyclic structure and a combined structure thereof. The aliphatic hydrocarbon group is a saturated or unsaturated group and preferably a saturated group. The aliphatic hydrocarbon group represented by $R^{42}$ or $R^{43}$ in general formula (P-II) is preferably an aliphatic hydrocarbon group having a carbon number of at least 1 and no greater than 20, and more preferably an aliphatic hydrocarbon group having a carbon number of at least 1 and no greater than 10. The aliphatic hydrocarbon group having a carbon number of at least 1 and no greater than 10 is preferably an alkyl group having a carbon number of at least 1 and no greater than 10, more preferably an alkyl group having a carbon number of at least 1 and no greater than 6, still more preferably an alkyl group having a carbon number of at least 1 and no greater than 3, and particularly preferably a methyl group or an ethyl group.

The alkoxy group represented by $R^{42}$ and $R^{43}$ in general formula (P-II) is preferably an alkoxy group having a carbon number of at least 1 and no greater than 6, more preferably an alkoxy group having a carbon number of at least 1 and no greater than 3, and still more preferably a methoxy group or an ethoxy group.

The aralkyl group represented by $R^{42}$ or $R^{43}$ in general formula (P-II) is preferably an aralkyl group having a carbon number of at least 7 and no greater than 12, more preferably a benzyl group, a phenethyl group, an α-naphthylmethyl group, or a β-naphthylmethyl group, and still more preferably a benzyl group or a phenethyl group.

The aryl group represented by $R^{42}$ or $R^{43}$ in general formula (P-II) is preferably an aryl group having a carbon number of at least 6 and no greater than 14, more preferably an aryl group having a carbon number of at least 6 and no greater than 10, and still more preferably a phenyl group.

The heterocyclic group represented by $R^{42}$ or $R^{43}$ in general formula (P-II) is preferably a heterocyclic group having a carbon number of at least 3 and no greater than 14, more preferably a heterocyclic group having a carbon number of at least 3 and no greater than 14 and having a nitrogen atom as a heteroatom, and still more preferably a pyridyl group.

The aralkyl group, the aryl group, and the heterocyclic group represented by $R^{42}$ or $R^{43}$ in general formula (P-II) may be substituted with a substituent. Preferable examples of the substituent include an alkyl group having a carbon number of at least 1 and no greater than 6, an alkoxy group having a carbon number of at least 1 and no greater than 6, a phenyl group, a halogen atom, a hydroxy group, a cyano group, a nitro group, and a phenylazo group. More preferable examples include an alkyl group having a carbon number of at least 1 and no greater than 6 (for example, a methyl group), a halogen atom (for example, a chlorine atom), and a phenylazo group.

$R^{42}$ and $R^{43}$ in general formula (P-II) preferably each represent—an alkyl group having a carbon number of at least 1 and no greater than 6; a heterocyclic group having a carbon number of at least 3 and no greater than 14; an aralkyl group having a carbon number of at least 7 and no greater than 12; an alkoxy group having a carbon number of at least 1 and no greater than 6; an aryl group having a carbon number of at least 6 and no greater than 14 and optionally being substituted with an alkyl group having a carbon number of at least 1 and no greater than 6, a halogen atom, or a phenylazo group; or a hydrogen atom. $R^{42}$ and $R^{43}$ in general formula (P-II) more preferably each represent a methyl group, an ethyl group, a pyridyl group, a benzyl group, a phenylethyl group, an ethoxy group, a methoxy group, a phenyl group, a dimethylphenyl group (more preferably, a 3,5-dimethylphenyl group), a chlorophenyl group (more preferably a 4-chlorophenyl group), a phenylazophenyl group (more preferably a 4-phenylazophenyl group), or a hydrogen atom. $R^{42}$ and $R^{43}$ preferably represent the same group as each other.

$R^{42}$ and $R^{43}$ in general formula (P-II) preferably each represent an alkyl group having a carbon number of at least 1 and no greater than 6; or an aryl group having a carbon number of at least 6 and no greater than 14 and optionally being substituted with an alkyl group having a carbon number of at least 1 and no greater than 6. $R^{42}$ and $R^{43}$ in general formula (P-II) more preferably each represent a methyl group, a phenyl group, or a dimethylphenyl group (more preferably, a 3,5-dimethylphenyl group). $R^{42}$ and $R^{43}$ preferably represent the same group as each other.

A second specific example of the perylene pigment is a compound represented by general formula (P-III).

(P-III)

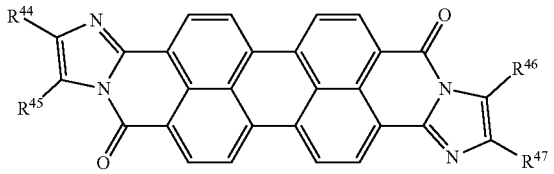

In general formula (P-III), $R^{44}$ to $R^{47}$ each represent, independently of one another, a hydrogen atom or a monovalent organic group. $R^{44}$ and $R^{45}$ may be bonded to each other to form a ring. $R^{4}$ and $R^{47}$ may be bonded to each other to form a ring.

The monovalent organic group represented by $R^{44}$ to $R^{47}$ in general formula (P-III) is defined the same as the monovalent organic group represented by $R^{42}$ and $R^{43}$ in general formula (P-II).

Examples of the ring formed by $R^{44}$ and $R^{45}$ bonded to each other and the ring formed by $R^{46}$ and $R^{47}$ bonded to each other include an aromatic hydrocarbon ring, an aromatic heterocycle, an aliphatic hydrocarbon ring, and an aliphatic heterocycle. The ring formed by $R^{44}$ and $R^{45}$ bonded to each other and the ring formed by $R^{46}$ and $R^{47}$ bonded to each other are each preferably a benzene ring, a naphthalene ring, a pyridine ring, or a tetrahydronaphthalene ring, and more preferably a benzene ring or a naphthalene ring. The benzene ring and the naphthalene ring formed by $R^{44}$ and $R^{45}$ bonded to each other are each condensed with an imidazole ring to which $R^{44}$ and $R^{45}$ are bonded. The benzene ring and the naphthalene ring formed by $R^{46}$ and $R^{47}$ bonded to each other are each condensed with an imidazole ring to which $R^{46}$ and $R^{47}$ are bonded.

The ring formed by $R^{44}$ and $R^{45}$ bonded to each other and the ring formed by $R^{46}$ and $R^{47}$ bonded to each other may each be substituted with a substituent. A substituent such as above is preferably a halogen atom, and more preferably a chlorine atom or a fluorine atom.

$R^{44}$ and $R^{45}$ in general formula (P-III) are preferably bonded to each other to form an aromatic hydrocarbon ring having a carbon number of at least 6 and no greater than 10 and optionally being substituted with a halogen atom. $R^{46}$ and $R^{47}$ are preferably bonded to each other to form an aromatic hydrocarbon ring having a carbon number of at least 6 and no greater than 10 and optionally being substituted with a halogen atom.

$R^{44}$ and $R^{45}$ in general formula (P-III) are preferably bonded to each other to form a benzene ring, a chlorobenzene ring, a fluorobenzene ring, or a naphthalene ring. $R^{46}$ and $R^{47}$ are preferably bonded to each other to form a benzene ring, a chlorobenzene ring, a fluorobenzene ring, or a naphthalene ring.

More preferable examples of the perylene pigment include perylene pigments represented by chemical formulas (P1) to (P17) (also referred to below as perylene pigments (P1) to (P17), respectively). Note that no particular limitations are placed on substitution positions of the pyridyl group in chemical formula (P5) and the fluoro group in chemical formula (P12).

(P1)

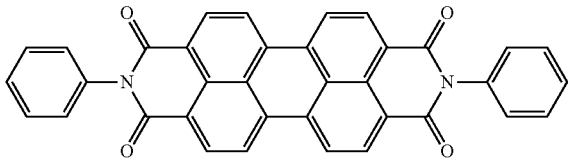

(P2)

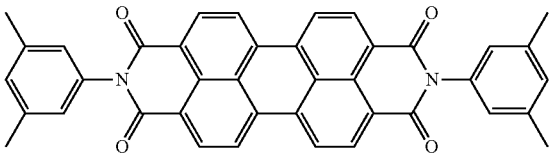

(P3)

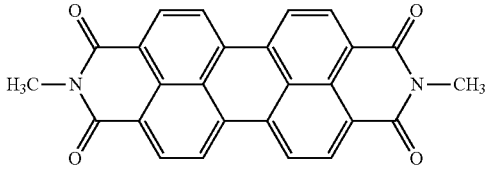

(P4)

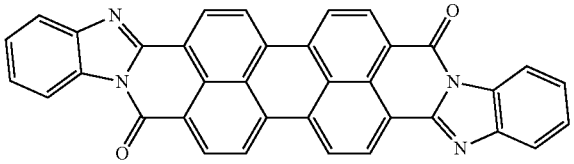

(P5)

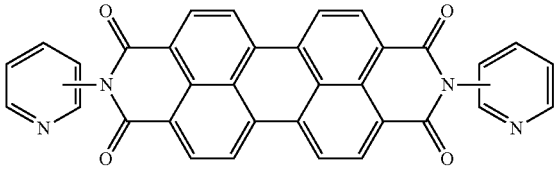

(P6)

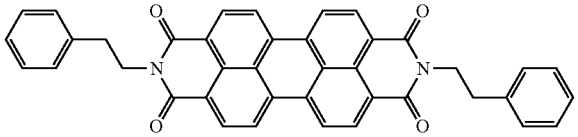

(P7)

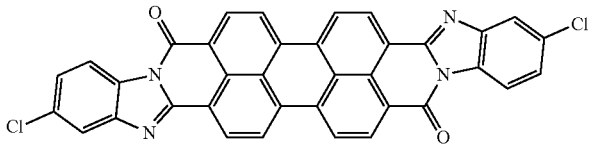

(P8)

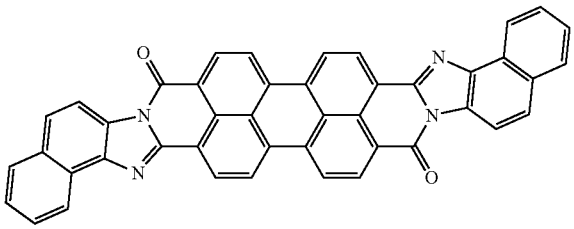

(P9)

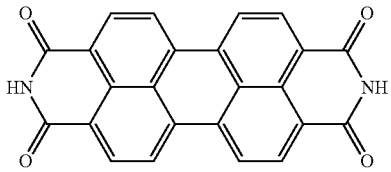

(P10)

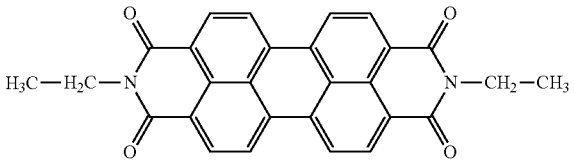

(P11)

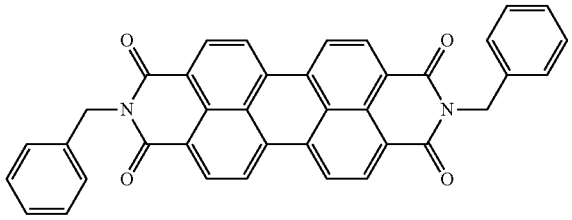

(P12)

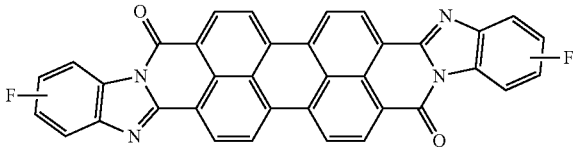

-continued (P13)

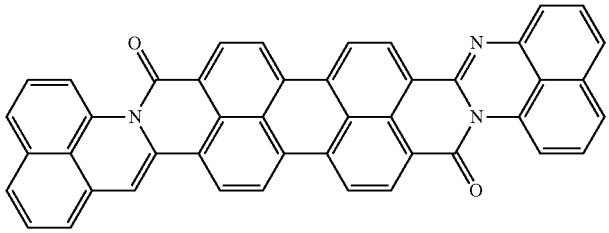

(P14)

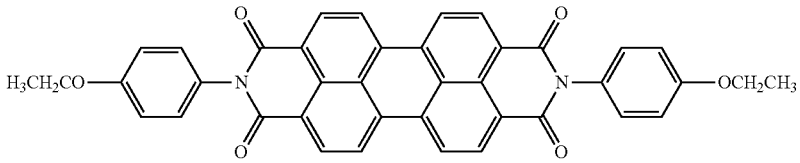

(P15)

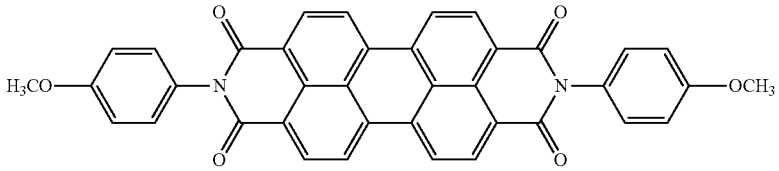

(P16)

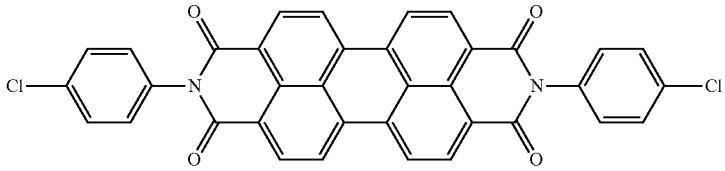

(P17)

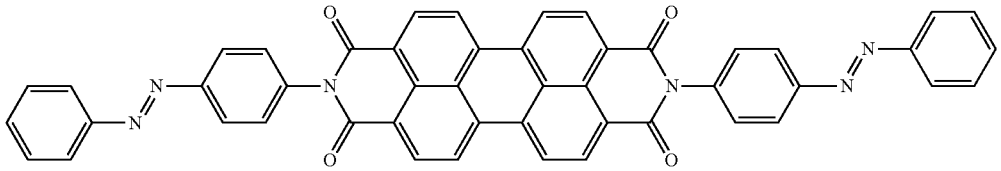

The perylene pigments (P1) to (P3), (P5), (P6), (P9), (P10), (P11), and (P14) to (P17) are preferable examples of the perylene pigment represented by general formula (P-II). The perylene pigments (P4), (P7), (P8), and (P12) are preferable examples of the perylene pigment represented by general formula (P-III). The perylene pigment (P13) is a preferable example of a perylene pigment other than the perylene pigments represented by general formulas (P-II) and (P-III).

In order to improve charging stability of the photosensitive member and inhibit crystallization of the photosensitive layer, the perylene pigment is preferably the perylene pigment (P1), (P2), or (P3)

Note that the n-type pigment may be an n-type pigment that is neither a perylene pigment nor an azo pigment (also referred to below as another n-type pigment). Examples of the another n-type pigment include polycyclic quinone pigments, squarylium pigments, pyranthrone pigments, perinone pigments, isoindoline pigments, quinaedrine pigments, pyrazolone pigments, and benzimidazolone pigments.

The photosensitive layer may contain only one n-type pigment or two or more n-type pigments. In order to improve charging stability and sensitivity characteristics of the photosensitive member, the amount of the n-type pigment is preferably greater than 0.00 parts by mass and more preferably at least 0.03 parts by mass relative to 3.0 parts by mass of the charge generating material. In order to improve charging stability and improved sensitivity characteristics of the photosensitive member, the amount of the n-type pigment is preferably no greater than 3.0 parts by mass relative to 3.0 parts by mass of the charge generating material and more preferably no greater than 2.0 parts by mass. When the photosensitive layer contains two or more n-type pigments, the amount means a total amount of the two or more n-type pigments.

(Additive)

The photosensitive layer may further contain an additive as necessary. Examples of additives include ultraviolet absorbing agents, antioxidants, radical scavengers, singlet quenchers, softeners, surface modifiers, extenders, thickeners, dispersion stabilizers, waxes, donors, surfactants, plasticizers, sensitizers, electron acceptor compounds, and leveling agents.

(Combination of Materials)

In order to improve charging stability of the photosensitive member and inhibit crystallization of the photosensitive layer, the combination of the hole transport material and the n-type pigment is preferably any of the combination examples C1 to C14 in Table 1 below. For the same reasons, it is preferable that the combination of the hole transport material and the n-type pigment is any of the combination examples C1 to C14 in Table 1 and the binder resin is the polycarbonate resin (R1), (R2), (R3), or (R4). For the same reasons, it is preferable that the combination of the hole transport material and the n-type pigment is any of the combination examples C1 to C14 in Table 1 and the charge generating material is Y-form titanyl phthalocyanine. For the same reasons, it is preferable that the combination of the hole transport material and the n-type pigment is any of the combination examples C1 to C14 in Table 1, the binder resin is the polycarbonate resin (R1), (R2), (R3), or (R4), and the charge generating material is Y-form titanyl phthalocyanine.

TABLE 1

| Example | HTM | n-type |
|---|---|---|
| C1 | 1-1 | A1 |
| C2 | 1-1 | A2 |
| C3 | 1-1 | A3 |
| C4 | 1-1 | A4 |
| C5 | 1-1 | P1 |
| C6 | 1-1 | P2 |
| C7 | 1-1 | P3 |
| C8 | 1-2 | A1 |
| C9 | 1-2 | A2 |
| C10 | 1-2 | A3 |
| C11 | 1-2 | A4 |
| C12 | 1-2 | P1 |
| C13 | 1-2 | P2 |
| C14 | 1-2 | P3 |

In order to improve charging stability of the photosensitive member and inhibit crystallization of the photosensitive layer, the combination of the hole transport material, the n-type pigment, and the electron transport material is preferably any of the combination examples D1 to D70 in Table 2 below. For the same reasons, it is preferable that the combination of the hole transport material, the n-type pigment, and the electron transport material is any of the combination examples D to D70 in Table 2 and the binder resin is the polycarbonate resin (R1), (R2), (R3), or (R4). For the same reasons, it is preferable that the combination of the hole transport material, the n-type pigment, and the electron transport material is any of the combination examples D1 to D70 in Table 2 and the charge generating material is Y-form titanyl phthalocyanine. For the same reasons, it is preferable that the combination of the hole transport material, the n-type pigment, and the electron transport material is any of the combination examples D1 to D70 in Table 2, the binder resin is the polycarbonate resin (R1), (R2), (R3), or (R4), and the charge generating material is Y-form titanyl phthalocyanine.

TABLE 2

| Example | HTM | n-type | ETM |
|---|---|---|---|
| D1 | 1-1 | A1 | ET1 |
| D2 | 1-1 | A1 | ET2 |
| D3 | 1-1 | A1 | ET3 |
| D4 | 1-1 | A1 | ET4 |
| D5 | 1-1 | A1 | ET5 |
| D6 | 1-1 | A2 | ET1 |
| D7 | 1-1 | A2 | ET2 |
| D8 | 1-1 | A2 | ET3 |
| D9 | 1-1 | A2 | ET4 |
| D10 | 1-1 | A2 | ET5 |
| D11 | 1-1 | A3 | ET1 |
| D12 | 1-1 | A3 | ET2 |
| D13 | 1-1 | A3 | ET3 |
| D14 | 1-1 | A3 | ET4 |

TABLE 2-continued

| Example | HTM | n-type | ETM |
|---|---|---|---|
| D15 | 1-1 | A3 | ET5 |
| D16 | 1-1 | A4 | ET1 |
| D17 | 1-1 | A4 | ET2 |
| D18 | 1-1 | A4 | ET3 |
| D19 | 1-1 | A4 | ET4 |
| D20 | 1-1 | A4 | ET5 |
| D21 | 1-1 | P1 | ET1 |
| D22 | 1-1 | P1 | ET2 |
| D23 | 1-1 | P1 | ET3 |
| D24 | 1-1 | P1 | ET4 |
| D25 | 1-1 | P1 | ET5 |
| D26 | 1-1 | P2 | ET1 |
| D27 | 1-1 | P2 | ET2 |
| D28 | 1-1 | P2 | ET3 |
| D29 | 1-1 | P2 | ET4 |
| D30 | 1-1 | P2 | ET5 |
| D31 | 1-1 | P3 | ET1 |
| D32 | 1-1 | P3 | ET2 |
| D33 | 1-1 | P3 | ET3 |
| D34 | 1-1 | P3 | ET4 |
| D35 | 1-1 | P3 | ET5 |
| D36 | 1-2 | A1 | ET1 |
| D37 | 1-2 | A1 | ET2 |
| D38 | 1-2 | A1 | ET3 |
| D39 | 1-2 | A1 | ET4 |
| D40 | 1-2 | A1 | ET5 |
| D41 | 1-2 | A2 | ET1 |
| D42 | 1-2 | A2 | ET2 |
| D43 | 1-2 | A2 | ET3 |
| D44 | 1-2 | A2 | ET4 |
| D45 | 1-2 | A2 | ET5 |
| D46 | 1-2 | A3 | ET1 |
| D47 | 1-2 | A3 | ET2 |
| D48 | 1-2 | A3 | ET3 |
| D49 | 1-2 | A3 | ET4 |
| D50 | 1-2 | A3 | ET5 |
| D51 | 1-2 | A4 | ET1 |
| D52 | 1-2 | A4 | ET2 |
| D53 | 1-2 | A4 | ET3 |
| D54 | 1-2 | A4 | ET4 |
| D55 | 1-2 | A4 | ET5 |
| D56 | 1-2 | P1 | ET1 |
| D57 | 1-2 | P1 | ET2 |
| D58 | 1-2 | P1 | ET3 |
| D59 | 1-2 | P1 | ET4 |
| D60 | 1-2 | P1 | ET5 |
| D61 | 1-2 | P2 | ET1 |
| D62 | 1-2 | P2 | ET2 |
| D63 | 1-2 | P2 | ET3 |
| D64 | 1-2 | P2 | ET4 |
| D65 | 1-2 | P2 | ET5 |
| D66 | 1-2 | P3 | ET1 |
| D67 | 1-2 | P3 | ET2 |
| D68 | 1-2 | P3 | ET3 |
| D69 | 1-2 | P3 | ET4 |
| D70 | 1-2 | P3 | ET5 |

In Tables 1 and 2. "Example" indicates "combination example", "HTM" indicates "hole transport material", "ETM" indicates "electron transport material", and "n-type" indicates "n-type pigment".

(Conductive Substrate)

No particular limitations are placed on the conductive substrate as long as the conductive substrate can be used in the photosensitive member. It is only required that at least a surface portion of the conductive substrate is formed from a conductive material. An example of the conductive substrate is a conductive substrate formed from a conductive material. Another example of the conductive substrate is a conductive substrate covered with a conductive material. Examples of conductive materials include aluminum, iron, copper, tin, platinum, silver, vanadium, molybdenum, chromium, cadmium, titanium, nickel, palladium, indium, stainless steel, and brass. Any one of the conductive materials listed above may be used independently, or any two or more of the conductive materials listed above may be used in combination (for example, as an alloy). Among the conductive materials listed above, aluminum or an aluminum alloy is preferable in terms of favorable charge mobility from the photosensitive layer to the conductive substrate.

The shape of the conductive substrate can be selected appropriately according to a configuration of an image forming apparatus in which the conductive substrate is to be used. The conductive substrate is, for example, in a sheet shape or a drum shape. The thickness of the conductive substrate is appropriately selected according to the shape of the conductive substrate.

(Intermediate Layer)

The intermediate layer (undercoat layer) for example contains inorganic particles and a resin for intermediate layer use (intermediate layer resin). Provision of the intermediate layer can facilitate flow of current generated when the photosensitive member is exposed to light and inhibit increasing resistance, while also maintaining insulation to a sufficient degree so as to inhibit occurrence of leakage current.

Examples of inorganic particles include particles of metals (examples include aluminum, iron, and copper), particles of metal oxides (examples include titanium oxide, alumina, zirconium oxide, tin oxide, and zinc oxide), and particles of non-metal oxides (for example, silica). Any one type of inorganic particles listed above may be used independently, or any two or more types of organic particles listed above may be used in combination.

Examples of the intermediate layer resin are the same as those of the binder resin described above. To favorably form the intermediate layer and the photosensitive layer, the intermediate layer resin is preferably different from the binder resin contained in the photosensitive layer. The intermediate layer may contain an additive. Examples of the additive that may be contained in the intermediate layer are the same as those of the additive that may be contained in the photosensitive layer.

(Photosensitive Member Production Method)

The following describes an example of a photosensitive member production method. The photosensitive member production method includes photosensitive layer formation. In the photosensitive layer formation, an application liquid for forming a photosensitive layer (also referred to below as an application liquid for photosensitive layer formation) is prepared. The application liquid for photosensitive layer formation is applied onto a conductive substrate. Next, at least a portion of a solvent contained in the applied application liquid for photosensitive layer formation is removed to form a photosensitive layer. The application liquid for photosensitive layer formation contains, for example, a charge generating material, a hole transport material, an electron transport material, a binder resin, an n-type pigment, and the solvent. The application liquid for photosensitive layer formation is prepared by dissolving or dispersing in the solvent the charge generating material, the hole transport material, the electron transport material, the binder resin, and the n-type pigment.

No particular limitations are placed on the solvent contained in the application liquid for photosensitive layer formation as long as components of the application liquid for photosensitive layer formation are soluble or dispersible in the solvent. Examples of the solvent include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination.

The application liquid for photosensitive layer formation is prepared by mixing the components to disperse the components in the solvent. Mixing or dispersion can for example be performed using a bead mill, a roll mill, a ball mill, an attritor, a paint shaker, or an ultrasonic disperser.

The method for applying the application liquid for photosensitive layer formation is not particularly limited as long as the application liquid can uniformly be applied. Examples of the application method include dip coating, spray coating, spin coating, and bar coating.

The method for removing at least a portion of the solvent contained in the applied application liquid for photosensitive layer formation may be, for example, heating, pressure reduction, or combinational use of heating and pressure reduction. More specifically, the method may for example be heat treatment (hot-air drying) using a high-temperature dryer or a reduced pressure dryer. The temperature of the heat treatment is for example 40° C. or higher and 150° C. or lower. Heat treatment time is for example 3 minutes or longer and 120 minutes or shorter.

Note that the photosensitive member production method may further include intermediate layer formation as necessary. Any known method may be selected as appropriate for the intermediate layer formation.

<Image Forming Apparatus>

Figure 4:
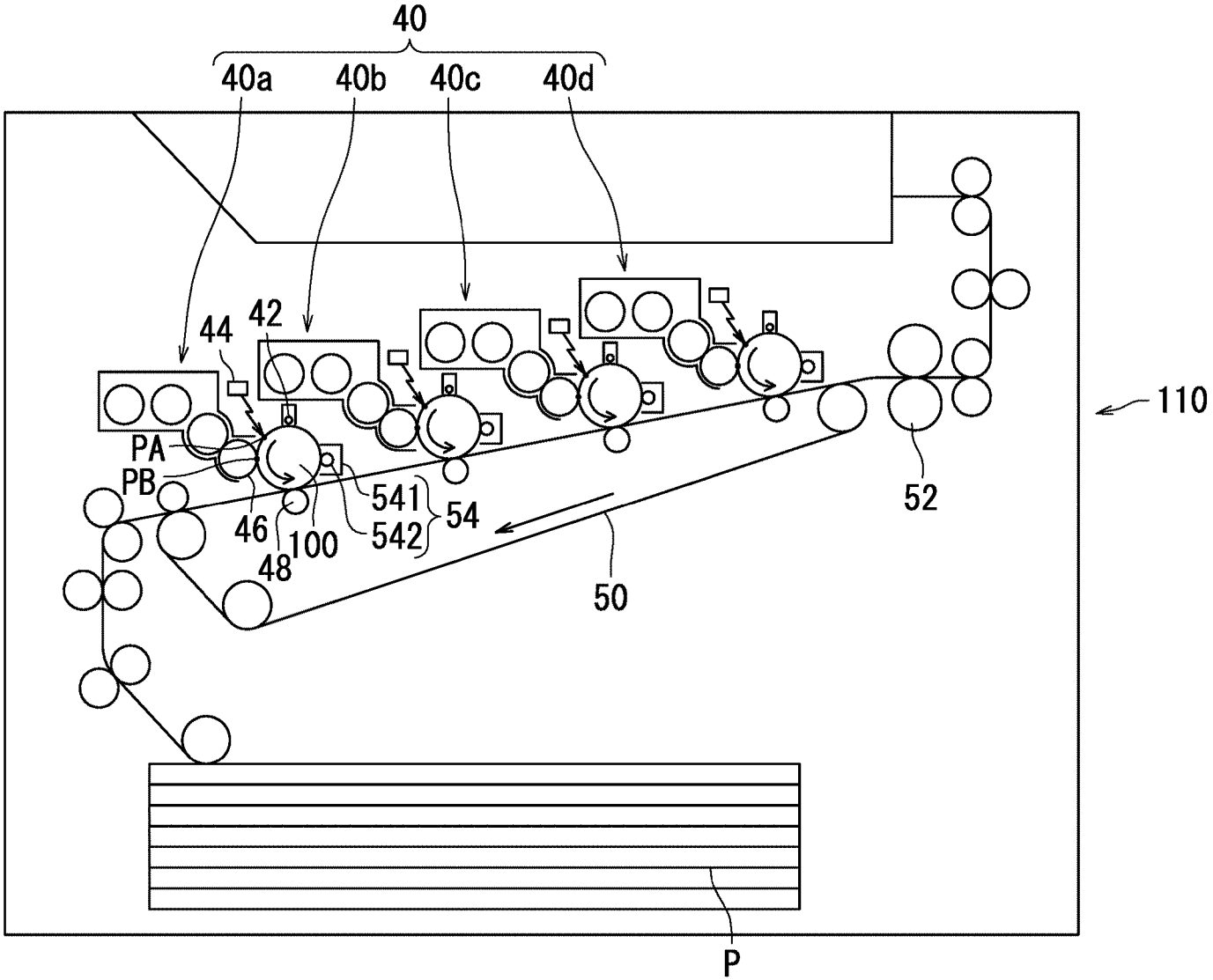
FIG. 4 is a cross sectional view of an example of an image forming apparatus.

The following describes an image forming apparatus including the photosensitive member 1 according to the present embodiment. The following describes the image forming apparatus through use of an example of a tandem color image forming apparatus with reference to FIG. 4. FIG. 4 is a cross sectional view of an example of the image forming apparatus.

An image forming apparatus 110 illustrated in FIG. 4 includes image forming units 40*a*, 40*b*, 40*c*, and 40*d*, a transfer belt 50, and a fixing device 52. Hereinafter, each of the image forming units 40*a*, 40*b*, 40*c*, and 40*d* is referred to as an image forming unit 40 where it is not necessary to distinguish among the image forming units 40*a*, 40*b*. 40*c*, and 40*d*.

The image forming unit 40 includes an image bearing member 100, a charger 42, a light exposure device 44, a developing device 46, a transfer device 48, and a cleaner 54. The image bearing member 100 is the photosensitive member 1 according to the present embodiment.

As already described, with the photosensitive member 1 according to the present embodiment, it is possible to improve charging stability of the photosensitive member 1 and inhibit crystallization of the photosensitive layer 3. Therefore, when provided with the photosensitive member 1 as the image bearing member 100, the image forming apparatus 110 can form a favorable image on a recording medium P.

The image bearing member 100 is disposed at a central position in the image forming unit 40. The image bearing member 100 is rotatable in a direction indicated by an arrow (counterclockwise direction) in FIG. 4. Around the image bearing member 100, the charger 42, the light exposure device 44, the developing device 46, the transfer device 48, and the cleaner 54 are disposed in the stated order from upstream in a rotation direction of the image bearing member 100.

Toner images in different colors (for example, four colors of black, cyan, magenta, and yellow) are sequentially superimposed on the recording medium P placed on the transfer belt 50 by the respective image forming units 40*a* to 40*d*.

The charger 42 positively charges a surface (for example, a circumferential surface) of the image bearing member 100. The charger 42 is, for example, a scorotron charger.

The light exposure device 44 irradiates the charged surface of the image bearing member 100 with exposure light. That is, the light exposure device 44 exposes the charged surface of the image bearing member 100 to light. As a result, an electrostatic latent image is formed on the surface of the image bearing member 100. The electrostatic latent image is formed based on image data input to the image forming apparatus 110.

The developing device 46 supplies a toner to the surface of the image bearing member 100 and develops the electrostatic latent image into a Loner image. The developing device 46 develops the electrostatic latent image into a toner image while in contact with the surface of the image bearing member 100. That is, the image forming apparatus 110 employs a contact developing process. The developing device 46 is, for example, a developing roller. In a case using a one-component developer, the developing device 46 supplies a toner that is the one-component developer to the electrostatic latent image formed on the surface of the image bearing member 100. In a case using a two-component developer, the developing device 46 supplies a toner of the two-component developer including the toner and a carrier to the electrostatic latent image formed on the surface of the image bearing member 100. In this way, the image bearing member 100 bears a toner image.

A time from a specific region of the surface of the image bearing member 100 passing an exposure position PA to the specific region arriving at a development position PB (also referred to below as an exposure-development time) is 100 milliseconds or shorter. The exposure position PA is a position at which the exposure light from the exposure device 44 enters the surface of the image bearing member 100. The development position PB is a position at which the surface of the image bearing member 100 comes in contact with the developing device 46 or comes closest to the developing device 46. The specific region is, for example, a point on the surface of the image bearing member 100 (for example, a point selected at random).

The transfer belt 50 conveys the recording medium P between the image bearing member 100 and the transfer device 48. The transfer belt 50 is an endless belt. The transfer belt 50 is rotatable in a direction indicated by an arrow (clockwise direction) in FIG. 4.

The transfer device 48 transfers the toner image developed by the developing device 46 from the surface of the image bearing member 100 to the recording medium P that is a transfer target. Specifically, the transfer device 48 transfers the toner image from the surface of the image bearing member 100 to the recording medium P in a state where the surface of the image bearing member 100 and the recording medium P are in contact with each other. That is, the image forming apparatus 110 employs a direct transfer process. The transfer device 48 is, for example, a transfer roller.

The cleaner 54 collects toner adhering to the surface of the image bearing member 100. The cleaner 54 includes a housing 541 and a cleaning roller 542. The cleaner 54 does not include a cleaning blade. The cleaning roller 542 is disposed in the housing 541. The cleaning roller 542 is disposed so as to contact the surface of the image bearing member 100. The cleaning roller 542 polishes the surface of the image bearing member 100 to collect toner adhering to the surface of the image bearing member 100 into the housing 541.

The recording medium P having thereon the toner image transferred by the transfer device 48 is conveyed to the fixing device 52 by the transfer belt 50. The fixing device 52 includes for example either or both a heating roller and a pressure roller. The toner image transferred by the transfer device 48, which is unfixed yet, receives either or both heat and pressure by the fixing device 52. As a result of application of either or both heat and pressure, the toner image is fixed onto the recording medium P. Through the above, an image is formed on the recording medium P.

Although an example of the image forming apparatus has been described so far, the image forming apparatus is not limited to the above-described image forming apparatus 110. The above-described image forming apparatus 110 is a color image forming apparatus, but the image forming apparatus may be a monochrome image forming apparatus. In a case of a monochrome image forming apparatus, the image forming apparatus may include only one image forming unit, for example. The above-described image forming apparatus 110 is a tandem image forming apparatus, but the image forming apparatus may be for example a rotary image forming apparatus. Although the charger 42 has been described using a scorotron charger as an example thereof, the charger may be a charger other than the scorotron charger (for example, a charging roller, a charging brush, or a corotron charger). The above-described image forming apparatus 110 employs a contact developing process, but the image forming apparatus may employs for example a non-contact developing process. The above-described image forming apparatus 110 employs a direct transfer process, but the image forming apparatus may employ an intermediate transfer process. When the image forming apparatus employs an intermediate transfer process, an intermediate transfer belt corresponds to the transfer target. The above-described cleaner 54 includes the cleaning roller 542 and does not include the cleaning blade, but the cleaner 54 may include a cleaning roller 542 and a cleaning blade. The above-described image forming unit 40 does not include a static eliminator, but the image forming unit may further include a static eliminator.

<Process Cartridge>

The following describes an example of a process cartridge including the photosensitive member 1 of the present embodiment with further reference to FIG. 4. The process cartridge corresponds to each of the image forming units 40*a* to 40*d*. The process cartridge includes the image bearing member 100. The image bearing member 100 is the photosensitive member 1 according to the present embodiment. In addition to the image bearing member 100, the process cartridge further includes at least one of the charger 42 and the cleaner 54.

As already described, according to the photosensitive member 1 of the present embodiment, it is possible to improve charging stability of the photosensitive member 1 and inhibit the crystallization of the photosensitive layer 3. Therefore, when provided with the photosensitive member 1 as the image bearing member 100, the process cartridge can form a favorable image on a recording medium P.

The process cartridge may include at least one of the light exposure device 44, the developing device 46, and the transfer device 48, in addition to the image bearing member 100, the charger 42, and the cleaner 54. The process cartridge may further include a static eliminator (not illustrated). The process cartridge may be designed to be freely attachable to and detachable from an image forming apparatus 110. In the above configuration, the process cartridge is easy to handle and can therefore be easily and quickly replaced, together with the photosensitive member 1, when sensitivity characteristics or the like of the photosensitive member 1 degrade. The process cartridge including the photosensitive member 1 according to the present embodiment has been described so far with reference to FIG. 4.

EXAMPLES

The following provides more specific description of the present disclosure through use of Examples. However, the present disclosure is not limited to the scope of Examples.

First, the following charge generating material, electron transport materials, hole transport materials, binder resins, and n-type pigments were prepared as materials for forming photosensitive layers of photosensitive members.

(Charge Generating Material)

Y-form titanyl phthalocyanine was prepared as a charge generating material.

(Electron Transport Material)

The compounds (ET1) to (ET5) described in association with the embodiment were each prepared as an electron transport material.

(Hole Transport Material)

The compounds (1-1) and (1-2) described in association with the embodiment were each prepared as a hole transport material. The compounds (1-1) and (1-2) were synthesized by the following methods.

(Synthesis of Compound (1-1))

In a 500-mL three-necked flask, 4,4"-dibromo-p-terphenyl (11.98 g, 30.9 mmol), palladium(II) acetate (0.069 g, 0.307 mmol), (4-dimethylaminophenyl)di-tert-butylphosphine (0.205 g, 0.772 mmol), and sodium tert-butoxide (7.702 g, 80.15 mmol) were placed. The air in the flask was replaced with nitrogen gas by repetition of degasification in the flask and nitrogen gas replacement twice. Subsequently, (2,4-dimethylphenyl)(4'-methylphenyl)amine (13.85 g, 63.3 mmol) and xylene (100 mL) were placed in the flask. The flask contents were stirred under reflux at 120° C. for 3 hours. Next, the temperature of the flask contents was lowered to 50° C. The flask contents were filtered to remove ash, and a filtrate was obtained. To the filtrate, activated clay ("SA-1", product of Nippon Activated Clay Co., Ltd., 24 g) was added and stirred at 80° C. for 10 minutes to give a mixture. The mixture was filtered to give a filtrate. Xylene in the filtrate was evaporated off under reduced pressure to give a residue. To the residue, 20 g of toluene was added and heated to 100° C. By the heating, the residue was dissolved in the toluene to give a solution. To the solution, n-hexane was added until the solution became slightly cloudy. Next, the solution was cooled to 5° C., and precipitated crystals were separated by filtration. The obtained crystals were dried, and thus the compound (1-1) was obtained. The yield of the compound (1-1) was 18.2 g. The yield of the compound (1-1) from 4,4"-dibromo-p-terphenyl was 90.8 mol %.

(Synthesis of Compound (1-2))

Compound (1-2) was obtained by the same method as the above synthesis of Compound (1-1) in all aspects except that 63.3 mmol of (2,4-dimethylphenyl)(4'-methylphenyl)amine was changed to 63.3 mmol of (2-ethylphenyl)(4'-methylphenyl)amine.

A $^1$H-NMR spectrum of each synthesized compound (1-1) and (1-2) was plotted using a proton nuclear magnetic resonance ($^1$H-NMR) spectrometer (product of JASCO Corporation, 300 MHz). $CDCl_3$ was used as a solvent. Tetramethylsilane (TMS) was used as an internal standard sample. Chemical shift values of the compound (1-1) as a representative example of the compounds (1-1) and (1-2) are shown below. It was confirmed from chemical shift values that the compound (1-1) was obtained. It was also confirmed by the same method that the compound (1-2) was obtained.

Compound (1-1): $^1$H-NMR (300 MHz, $CDC_3$) δ=7.57 (s, 4H), 7.42-7.45 (m, 4H), 7.01-7.07 (m, 18H), 2.34 (s, 6H), 2.29 (s, 6H), 2.03 (s, 6H).

Next, compounds represented by the following chemical formulas (HT3) to (HT16) (also referred to below as compounds (HT3) to (HT16), respectively) were prepared as hole transport materials used in Comparative Examples.

(HT3)

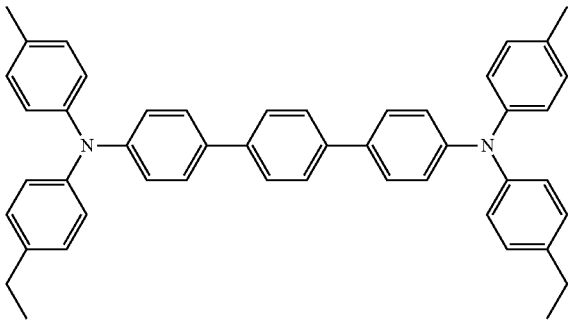

(HT4)

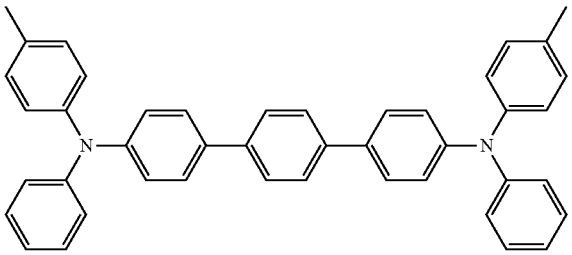

-continued
(HT5)
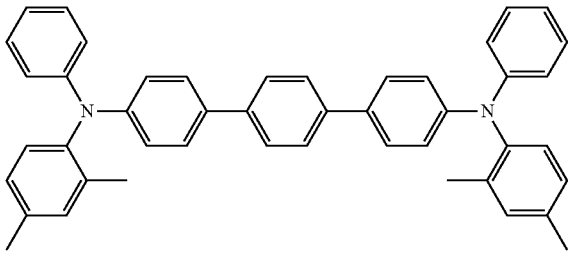
(HT6)
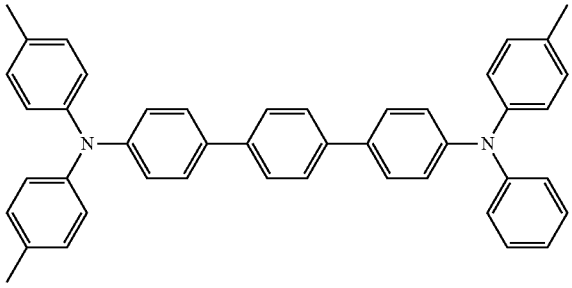
(HT7)
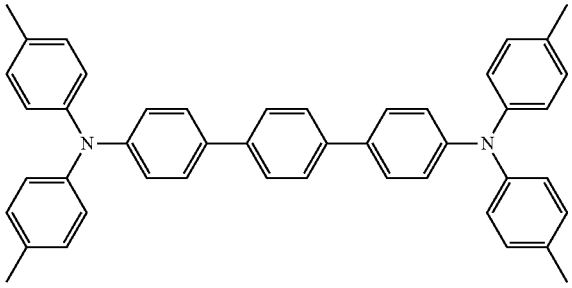
(HT8)
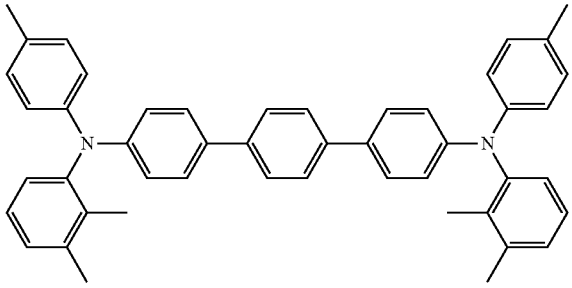
(HT9)
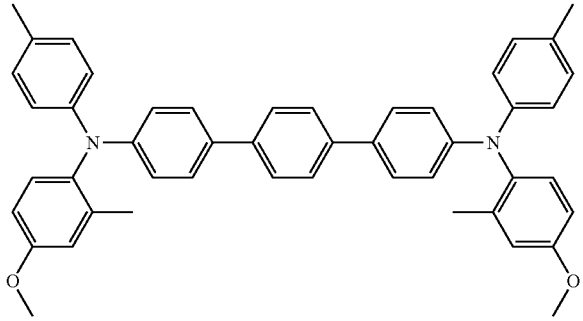
(HT10)
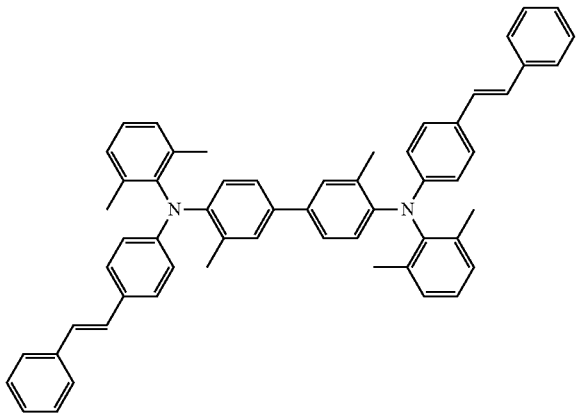
(HT11)
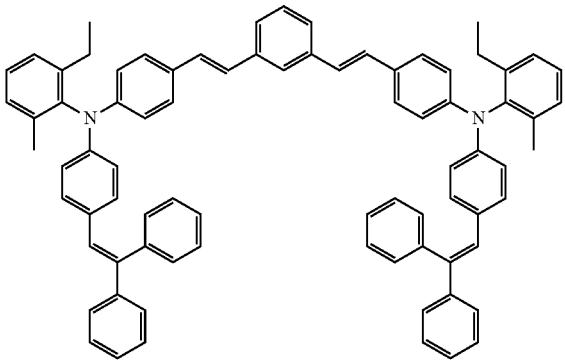
(HT12)
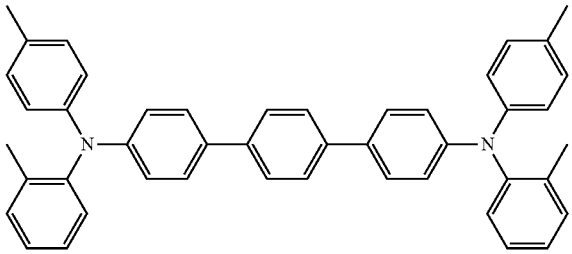

-continued (HT13)

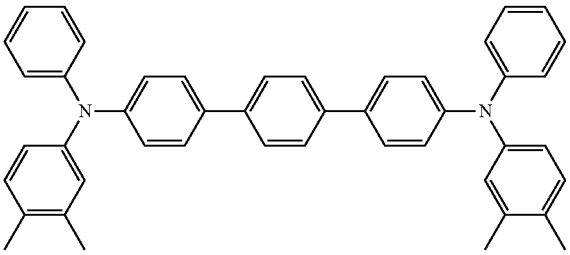

(HT14)

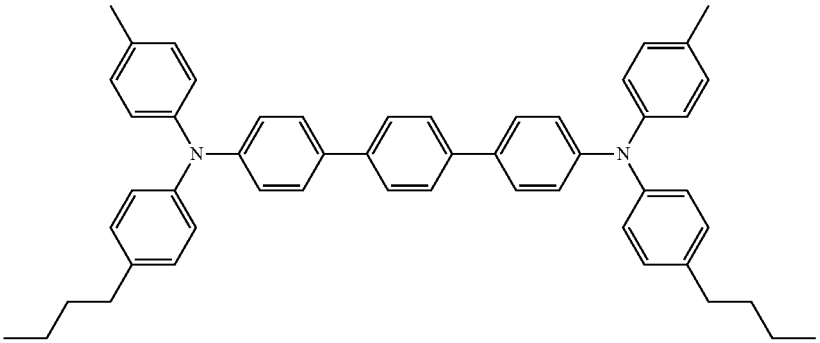

(HT15)

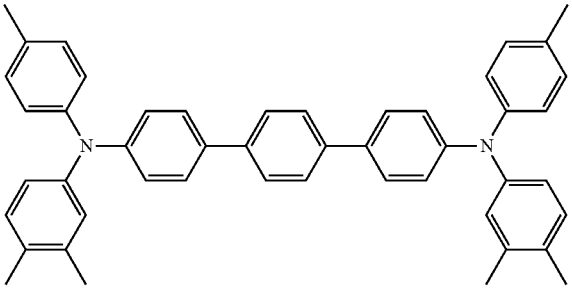

(HT16)

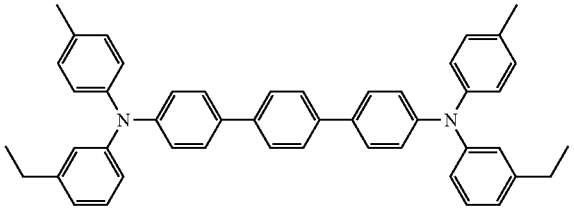

The polycarbonate resins (R1) to (R4) described above in association with the embodiment were prepared as binder resins. The viscosity average molecular weights of the polycarbonate resins (R1), (R2), (R3), and (R4) were 40,000, 40,000, 40,000, and 40,000, respectively.

(n-Type Pigment)

The azo pigments (A1) to (A4) and perylene pigments (P1) to (P3) described above in association with the embodiment were prepared as n-type pigments.

<Production of Photosensitive Member>

Photosensitive members (A-1) to (A-15) and (B-1) to (B-15) were produced using the charge generating material, the hole transport materials, the binder resins, the electron transport materials, and the n-type pigments described above.

(Production of Photosensitive Member (A-1))

An application liquid for photosensitive layer formation was obtained by mixing 3.0 parts by mass of Y-form titanyl phthalocyanine as a charge generating material, 70.0 parts by mass of the compound (1-1) as a hole transport material, 100.0 parts by mass of the polycarbonate resin (R1) as a binder resin, 30.0 parts by mass of the compound (ET1) as an electron transport material, 2.0 parts by mass of the azo pigment (A1) as an n-type pigment, and 800.0 parts by mass of tetrahydrofuran as a solvent were mixed using a ball mill for 50 hours. The application liquid for photosensitive layer formation was applied onto a conductive substrate (an aluminum drum-shaped support) by dip coating. After the application, the application liquid was hot-air dried at 120° C. for 60 minutes. Through the above, a photosensitive layer (film thickness: 28 μm) was formed on the conductive substrate to produce the photosensitive member (A-1). The photosensitive member (A-1) had a single-layer photosensitive layer on the conductive substrate.

(Production of Photosensitive Members (A-2) to (A-15) and (B-2) to (B-15))

Photosensitive members (A-2) to (A-15) and (B-2) to (B-15) were produced by the same method as the production method of the photosensitive member (A-1) in all aspects except that the n-type pigments, the hole transport materials, the electron transport materials, and the binder resins used were as shown in Table 3.

(Production of Photosensitive Member (B-1))

The photosensitive member (B-1) was produced by the same method as the production method of the photosensitive member (A-1) in all aspects except that the n-type pigment was not added.

<Evaluation of Sensitivity Characteristics of Photosensitive Member>

Evaluation of sensitivity characteristics was performed on each of the photosensitive members (A-1) to (A-15) and (B-1) to (B-15) using a drum sensitivity test device (product of Gen-Tech, Inc.) in an environment at a temperature of 10° C. and a relative humidity of 15%. Specifically, a surface of the photosensitive member was charged to +750 V using the drum sensitivity test device. Next, monochromatic light (wavelength: 780 nm, light exposure: 0.2 μJ/cm$^2$) was taken out from light of a halogen lamp using a bandpass filter, and the surface of the photosensitive member was irradiated with the monochromatic light. A surface potential of the photosensitive member was measured when 70 milliseconds elapsed from termination of the monochrome light irradiation. The surface potential measured as above was determined to be a post-exposure potential $V_L$ (unit: +V). Using the post-exposure potential $V_L$, sensitivity characteristics of the photosensitive member were evaluated in accordance with the following criteria. The results of the evaluation of sensitivity characteristics are shown in Table 3. Note that a photosensitive member having sensitivity characteristics rated as Evaluation C was evaluated as having poor sensitivity characteristics.

<Evaluation Criteria of Sensitivity Characteristics>

Evaluation A: The post-exposure potential $V_L$ was lower than +240 V.

Evaluation B: The post-exposure potential $V_L$ was +240 V or higher and lower than +270 V.

Evaluation C: The post-exposure potential $V_L$ was +270 V or higher.

<Evaluation of Charging Stability of Photosensitive Member>

Evaluation of charging stability was performed on each of the photosensitive members (A-1) to (A-15) and (B-1) to (B-15) in an environment at a temperature of 10° C. and a relative humidity of 15%. For the evaluation of charging stability, an evaluation apparatus (a modified version of a color image forming apparatus "FS-C5250DN", product of KYOCERA Document Solutions Inc.) was used. The evaluation apparatus included a scorotron charger and a cleaning roller, and did not include a cleaning blade. The exposure-development time was set to 72 milliseconds.

First, an image A (entirely white image) was printed on three recording medium (A4 size paper) sheets using the evaluation apparatus. When printing on each sheet, the surface potential of the photosensitive member was measured at the development position. Since no exposure is performed in printing of a white image, the measured surface potential corresponds to the charge potential. The surface potential was measured once per sheet, 3 times in total. The average value of the three measured surface potentials was determined to be a charge potential $V_{01}$ (unit: +V) before printing test.

Next, a printing test was performed. In the printing test, an image B (print pattern image having a printing rate of 5%) was printed on 10,000 recording medium (A4 size paper) sheets at regular intervals of 15 seconds using the evaluation apparatus. Immediately after the printing test, the image A (entirely white image) was printed on three recording medium (A4 size paper) sheets. When printing on each sheet, the surface potential of the photosensitive member was measured at the development position. The surface potential was measured once per sheet, 3 times in total. The average value of the three measured surface potentials was determined to be a charge potential $V_{02}$ (unit: +V) after printing test.

A value ($V_{01}$-$V_{02}$) obtained by subtracting the charge potential $V_{02}$ after the printing test from the charge potential $V_{01}$ before the printing test was determined to be an amount of decrease in charge potential $\Delta V_0$ (unit: V). Using the amount of decrease in charge potential $\Delta V_0$, charging stability of the photosensitive member was evaluated in accordance with the following criteria. The results of the evaluation of charging stability are shown in Table 3. Note that a photosensitive member having a charging stability rated as Evaluation C was evaluated as having poor charging stability.

(Evaluation Criteria of Charging Stability)

Evaluation A: The amount of decrease in charge potential $\Delta V_0$ was 60 V or lower.

Evaluation B: The amount of decrease in charge potential $\Delta V_0$ was 60 V or higher and lower than 110 V.

Evaluation C: The amount of decrease in charge potential $\Delta V_0$ was 110 V or lower.

<Evaluation of Crystallization Inhibition of Photosensitive Layer>

First, photosensitive members for evaluation of crystallization inhibition were prepared. Specifically, photosensitive members (A-1) to (A-15) and (B-1) to (B-15) for evaluation of crystallization inhibition were prepared by the same method as that described in <Production of Photosensitive Member> in all aspects except that the application liquid after the application was, instead of being hot-air dried at 120° C. for 60 minutes, air dried in the dark (at a temperature of 23° C. and a relative humidity of 50%) for 1 hour for promoting crystallization and subsequently hot-air dried at 120° C. for 60 minutes. The entire surface (photosensitive layer) of each photosensitive member for evaluation of crystallization inhibition was observed with the naked eye. The presence or absence of a crystallized portion on the photosensitive layer was examined. Based on the examination result, whether or not crystallization was inhibited was evaluated in accordance with the following evaluation criteria. The evaluation results are shown in Table 3. Note that a photosensitive member having a crystallization inhibition rated as C was evaluated as having a photosensitive layer where crystallization was not inhibited.

(Evaluation Criteria of Crystallization Inhibition)

Evaluation A: No crystallized portions were observed.

Evaluation B: Slightly crystallized portions were observed.

Evaluation C: Crystallized portions were clearly observed.

In Table 3, n-type, HTM, Resin, and ETM indicate n-type pigment, hole transport material, binder resin, and electron transport material, respectively.

TABLE 3

| | Photosensitive Member | n-type | HTM | ETM | Resin | Evaluation | | |
|---|---|---|---|---|---|---|---|---|
| | | | | | | Sensitivity | Charging Stability | Crystallization Inhibition |
| Example 1 | A-1 | A1 | 1-1 | ET1 | R1 | A | A | A |
| Example 2 | A-2 | A2 | 1-1 | ET1 | R1 | A | A | A |
| Example 3 | A-3 | A3 | 1-1 | ET1 | R1 | A | A | A |
| Example 4 | A-4 | A4 | 1-1 | ET1 | R1 | A | A | A |
| Example 5 | A-5 | P1 | 1-1 | ET1 | R1 | B | A | A |
| Example 6 | A-6 | P2 | 1-1 | ET1 | R1 | B | B | A |
| Example 7 | A-7 | P3 | 1-1 | ET1 | R1 | B | B | A |

TABLE 3-continued

| | Photosensitive Member | n-type | HTM | ETM | Resin | Evaluation | | |
|---|---|---|---|---|---|---|---|---|
| | | | | | | Sensitivity | Charging Stability | Crystallization Inhibition |
| Example 8 | A-8 | A1 | 1-2 | ET1 | R1 | A | A | A |
| Example 9 | A-9 | A1 | 1-1 | ET2 | R1 | A | A | A |
| Example 10 | A-10 | A1 | 1-1 | ET3 | R1 | A | A | B |
| Example 11 | A-11 | A1 | 1-1 | ET4 | R1 | A | A | A |
| Example 12 | A-12 | A1 | 1-1 | ET5 | R1 | A | A | A |
| Example 13 | A-13 | A1 | 1-1 | ET1 | R2 | A | A | A |
| Example 14 | A-14 | A1 | 1-1 | ET1 | R3 | A | A | A |
| Example 15 | A-15 | A1 | 1-1 | ET1 | R4 | A | A | A |
| Comparative Example 1 | B-1 | None | 1-1 | ET1 | R1 | C | C | A |
| Comparative Example 2 | B-2 | A1 | HT3 | ET1 | R1 | A | A | C |
| Comparative Example 3 | B-3 | A1 | HT4 | ET1 | R1 | A | A | C |
| Comparative Example 4 | B-4 | A1 | HT5 | ET1 | R1 | A | B | C |
| Comparative Example 5 | B-5 | A1 | HT6 | ET1 | R1 | A | B | C |
| Comparative Example 6 | B-6 | A1 | HT7 | ET1 | R1 | A | B | C |
| Comparative Example 7 | B-7 | A1 | HT8 | ET1 | R1 | B | B | C |
| Comparative Example 8 | B-8 | A1 | HT9 | ET1 | R1 | B | B | C |
| Comparative Example 9 | B-9 | A1 | HT10 | ET1 | R1 | A | C | B |
| Comparative Example 10 | B-10 | A1 | HT11 | ET1 | R1 | A | C | C |
| Comparative Example 11 | B-11 | A1 | HT12 | ET1 | R1 | B | B | C |
| Comparative Example 12 | B-12 | A1 | HT13 | ET1 | R1 | B | B | C |
| Comparative Example 13 | B-13 | A1 | HT14 | ET1 | R1 | A | B | C |
| Comparative Example 14 | B-14 | A1 | HT15 | ET1 | R1 | B | B | C |
| Comparative Example 15 | B-15 | A1 | HT16 | ET1 | R1 | B | B | C |

As shown in Table 3, the photosensitive layers of the photosensitive members (A-1) to (A-15) contained the compound (1-1) or (1-2) as a hole transport material. The photosensitive layers of the photosensitive members (A-1) to (A-15) each contained an n-type pigment (more specifically, one of azo pigments (A1) to (A4) and perylene pigments (P1) to (P3)). The photosensitive members (A-1) to (A-15) were each evaluated as A or B for the charging stability, which means that the photosensitive members each had favorable charging stability. In addition, the photosensitive members (A-1) to (A-15) were each evaluated as A or B for the crystallization inhibition, which means that crystallization was inhibited in the photosensitive members. Therefore, in the photosensitive members (A-1) to (A-15), improved charging stability and inhibition of crystallization of the photosensitive layer were both achieved. Furthermore, the photosensitive members (A-1) to (A-15) were each evaluated as A or B for the sensitivity characteristics, which means that improved charging stability and inhibition of crystallization of the photosensitive layer were both achieved without impairment of the sensitivity characteristics.

From the above, it was shown that the photosensitive member according to the present disclosure can achieve both improved charging stability and inhibition of crystallization of the photosensitive layer. Since the photosensitive member according to the present disclosure can achieve both improved charging stability and inhibition of crystallization of the photosensitive layer, the process cartridge and the image forming apparatus according to the present disclosure can form favorable images.

What is claimed is:

1. An electrophotographic photosensitive member comprising:

a conductive substrate; and a single-layer photosensitive layer, wherein the photosensitive layer contains a charge generating material, a hole transport material, an electron transport material, and a binder resin, the hole transport material includes a compound represented by a chemical formula (1-1) or (1-2), the photosensitive layer further contains an n-type pigment, and the binder resin includes a polycarbonate resin including a repeating unit represented by a chemical formula (R1), (R2), (R3), or (R4):

(1-1)
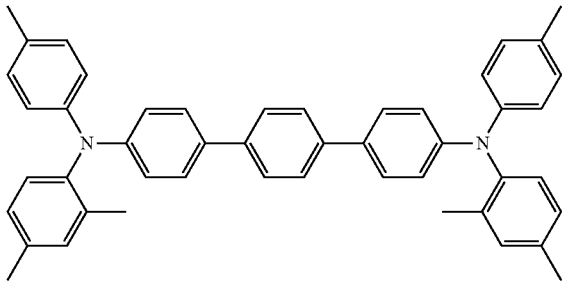
(1-2)
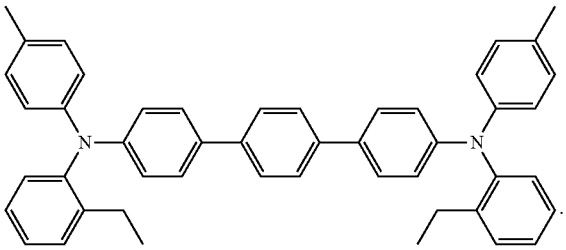
(R1)
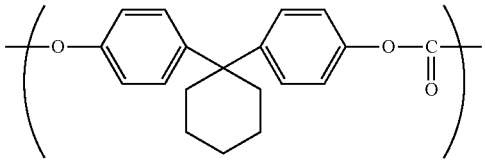
-continued
(R2)
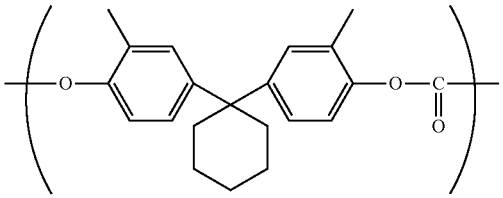
(R3)
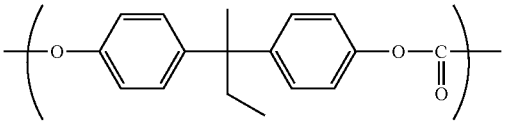
(R4)
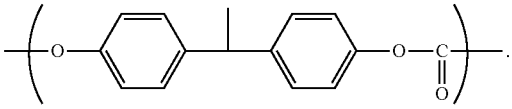
2. The electrophotographic photosensitive member according to claim 1, wherein
the n-type pigment is an azo pigment.
3. The electrophotographic photosensitive member according to claim 2, wherein
the azo pigment is represented by a chemical formula (A1), (A2), (A3), or (A4):
(A1)
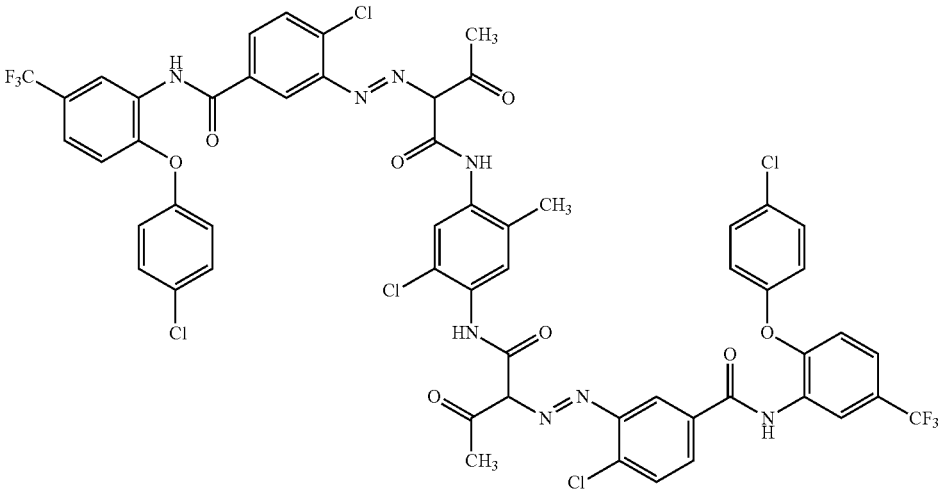

-continued
(A2)
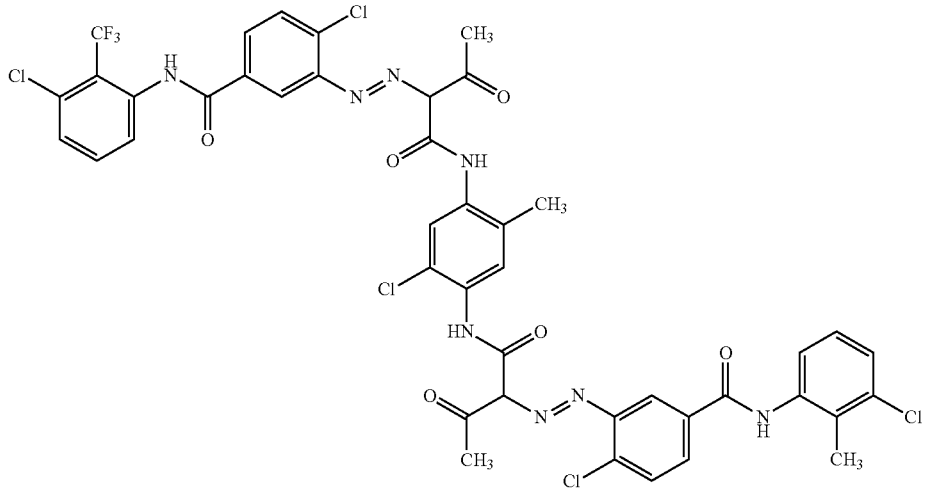
(A3)
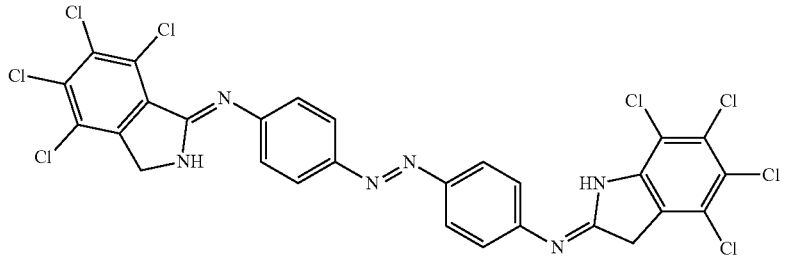
(A4)
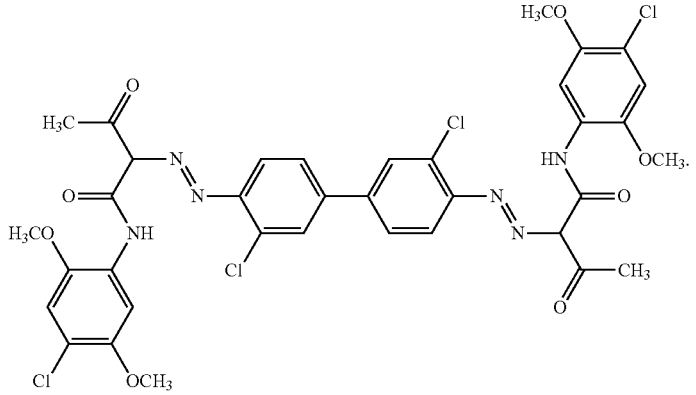
4. The electrophotographic photosensitive member according to claim 1, wherein
the n-type pigment is a perylene pigment.
5. The electrophotographic photosensitive member according to claim 4, wherein
the perylene pigment is represented by a chemical formula (P1), (P2), or (P3):
(P1)
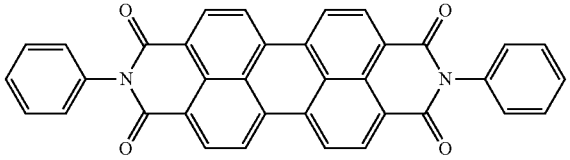
-continued
(P2)
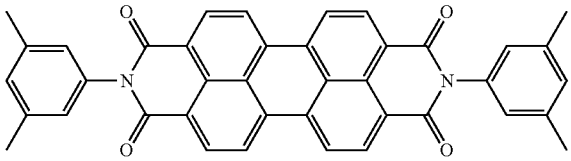
(P3)
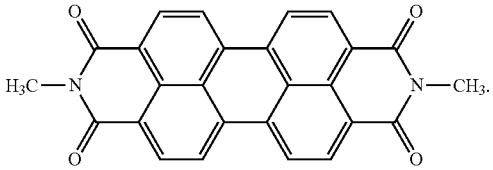

6. The electrophotographic photosensitive member according to claim 1, wherein the charge generating material is a phthalocyanine pigment.

7. The electrophotographic photosensitive member according to claim 1, wherein the charge generating material is titanyl phthalocyanine having a Y-form crystal structure.

8. The electrophotographic photosensitive member according to claim 1, wherein the electron transport material includes a compound represented by a general formula (10), (11), (12), (13), or (14):

(10)

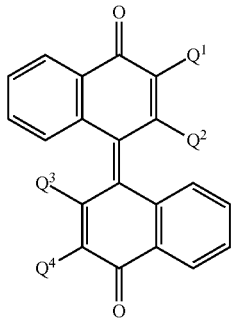

(11)

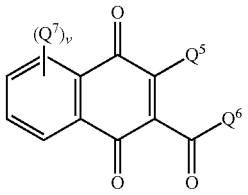

(12)

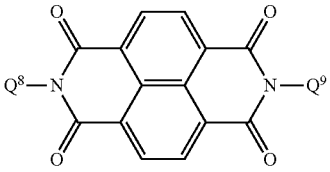

(13)

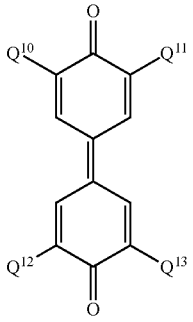

-continued (14)

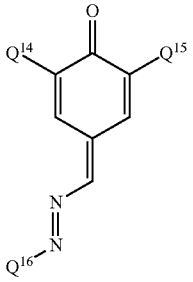

where in the general formula (10), $Q^1$, $Q^2$, $Q^3$, and $Q^4$, each represent, independently of one another, a hydrogen atom, an alkyl group having a carbon number of at least 1 and no greater than 6, an alkoxy group having a carbon number of at least 1 and no greater than 6, an aryl group having a carbon number of at least 6 and no greater than 14, or an aralkyl group having a carbon number of at least 7 and no greater than 20;

in the general formula (11), $Q^5$ represents an alkyl group having a carbon number of at least 1 and no greater than 6 or an aryl group having a carbon number of at least 6 and no greater than 14, $Q^6$ represents an alkyl group having a carbon number of at least 1 and no greater than 6, an aryl group having a carbon number of at least 6 and no greater than 14, an alkoxy group having a carbon number of at least 1 and no greater than 6, an aralkyl group having a carbon number of at least 7 and no greater than 20, an aryloxy group having a carbon number of at least 6 and no greater than 14, or an aralkyloxy group having a carbon number of at least 7 and no greater than 20, $Q^7$ represents an alkyl group having a carbon number of at least 1 and no greater than 6, and v represents an integer of at least 0 and no greater than 4;

in the general formula (12), $Q^8$ and $Q^9$ each represent, independently of each other, an aryl group having a carbon number of at least 6 and no greater than 14 and optionally being substituted with at least one alkyl group having a carbon number of at least 1 and no greater than 6;

in the general formula (13), $Q^{10}$, $Q^{11}$, $Q^{12}$, and $Q^{13}$ each represent, independently of one another, a hydrogen atom, an alkyl group having a carbon number of at least 1 and no greater than 6, an alkenyl group having a carbon number of at least 2 and no greater than 6, an alkoxy group having a carbon number of at least 1 and no greater than 6, an aryl group having a carbon number of at least 6 and no greater than 14, an aralkyl group having a carbon number of at least 7 and no greater than 20, or a heterocyclic group having a carbon number of at least 3 and no greater than 14; and in the general formula (14), $Q^{14}$, $Q^{15}$, and $Q^{16}$ each represent, independently of one another, alkyl group having a carbon number of at least 1 and no greater than 6, or an aryl group having a carbon number of at least 6 and no greater than 14 and optionally being substituted with a halogen atom.

9. The electrophotographic photosensitive member according to claim 8, wherein in the general formula (10), $Q^1$, $Q^2$, $Q^3$, and $Q^4$ each represent, independently of one another, a hydrogen atom or an alkyl group having a carbon number of at least 1 and no greater than 6;

in the general formula (11), $Q^5$ represents an aryl group having a carbon number of at least 6 and no greater than 14, $Q^6$ represents an aralkyloxy group having a carbon number of at least 7 and no greater than 20, and v represents 0;

in the general formula (12), $Q^8$ and $Q^9$ each represent, independently of each other, an aryl group having a carbon number of at least 6 and no greater than 14 and being substituted with 2 alkyl groups each having a carbon number of at least 1 and no greater than 6;

in the general formula (13), $Q^{10}$, $Q^{11}$, $Q^{12}$, and $Q^{13}$ each represent, independently of one another, an alkyl group having a carbon number of at least 1 and no greater than 6; and in the general formula (14), $Q^{14}$ and $Q^{15}$ each represent, independently of each other, an alkyl group having a carbon number of at least 1 and no greater than 6, and $Q^{16}$ represents an aryl group having a carbon number of at least 6 and no greater than 14 and being substituted with a halogen atom.

10. The electrophotographic photosensitive member according to claim 1, wherein the electron transport material includes a compound represented by a chemical formula (ET1), (ET2), (ET3), (ET4), or (ET5):

(ET1)

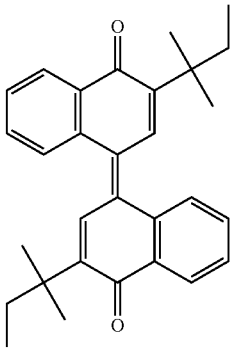

(ET2)

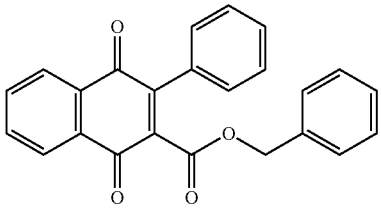

(ET3)

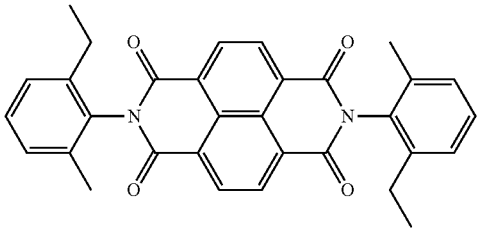

-continued (ET4)

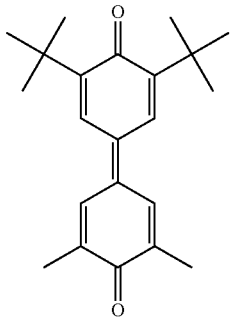

(ET5)

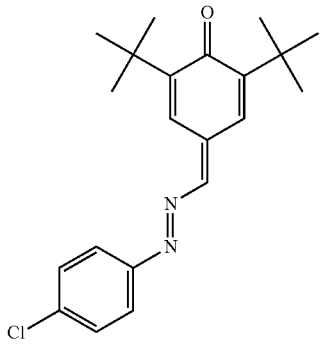

11. A process cartridge comprising the electrophotographic photosensitive member according to claim 1.

12. An image forming apparatus, comprising:

an image bearing member that is rotatable;

a charger configured to positively charge a surface of the image bearing member;

a light exposure device configured to irradiate the charged surface of the image bearing member with exposure light to form an electrostatic latent image on the surface of the image bearing member;

a developing device configured to develop the electrostatic latent image into a toner image; and a transfer device configured to transfer the toner image from the image bearing member to a transfer target, wherein the image bearing member is the electrophotographic photosensitive member according to claim 1.

13. The image forming apparatus according to claim 12, wherein a time from a specific region of the surface of the image bearing member passing an exposure position to the specific region arriving at a development position is 100 milliseconds or shorter, the exposure position is a position at which the exposure light enters the surface of the image bearing member, and the development position is a position at which the surface of the image bearing member comes in contact with the developing device or comes closest to the developing device.

* * * * *